US008640663B2

(12) United States Patent
Miyachi

(10) Patent No.: US 8,640,663 B2
(45) Date of Patent: Feb. 4, 2014

(54) OIL PRESSURE CONTROL APPARATUS

(75) Inventor: Eiji Miyachi, Nishio (JP)

(73) Assignee: Aisin Seiki Kabushiki Kaisha, Kariya-Shi, Aichi (JP)

( * ) Notice: Subject to any disclaimer, the term of this patent is extended or adjusted under 35 U.S.C. 154(b) by 0 days.

(21) Appl. No.: 13/816,358

(22) PCT Filed: May 18, 2011

(86) PCT No.: PCT/JP2011/061387
§ 371 (c)(1),
(2), (4) Date: Feb. 11, 2013

(87) PCT Pub. No.: WO2012/032813
PCT Pub. Date: Mar. 15, 2012

(65) Prior Publication Data

US 2013/0139916 A1 Jun. 6, 2013

(30) Foreign Application Priority Data

Sep. 6, 2010 (JP) ..... 2010-198790
Dec. 20, 2010 (JP) ..... 2010-282879

(51) Int. Cl.
*F01L 1/34* (2006.01)

(52) U.S. Cl.
USPC ..... 123/90.17; 123/90.12; 123/196 R

(58) Field of Classification Search
USPC ..... 123/90.12, 90.15, 90.17, 90.33, 90.34, 123/196 R; 464/160, 161
See application file for complete search history.

(56) References Cited

U.S. PATENT DOCUMENTS 8,347,846 B2 * 1/2013 Kobayashi et al. ..... 123/196 R
8,505,506 B2 * 8/2013 Miyachi et al. ..... 123/90.17
8,540,055 B2 * 9/2013 Ono et al. ..... 184/6.28

(Continued)

FOREIGN PATENT DOCUMENTS

EP 2 302 179 A2 3/2011
JP 53-78462 U 6/1978

(Continued)

OTHER PUBLICATIONS

Supplementary European Search Report issued on Jul. 22, 2013, by the European Patent Office in corresponding European Patent Application No. 11823292.5. (4 pages).

(Continued)

*Primary Examiner* — Thomas Denion
*Assistant Examiner* — Daniel Bernstein
(74) *Attorney, Agent, or Firm* — Buchanan Ingersoll & Rooney PC

(57) ABSTRACT

An oil pressure control apparatus includes: a pump that ejects oil by being driven by rotation of an engine; a first flow passage interconnecting the pump and a first predetermined portion; a second flow passage branching from the first flow passage and supplying oil to a second predetermined portion; and a flow passage area adjusting portion that adjusts a flow passage area of the second flow passage according to oil pressure in the second flow passage. The flow passage area adjusting portion includes a spool formed such that a first pressure receiving face and a second pressure receiving face having an area smaller than that of the first pressure receiving face oppose each other with the second flow passage interposed therebetween, with the spool moving according to oil pressure in the second flow passage, and a biasing member biasing the spool in a direction toward the second pressure receiving face.

13 Claims, 17 Drawing Sheets

(56) References Cited

U.S. PATENT DOCUMENTS

| | | | | |
|---|---|---|---|---|
| 2009/0311115 | A1* | 12/2009 | Ono et al. | 417/279 |
| 2011/0067667 | A1 | 3/2011 | Miyachi et al. | |
| 2011/0067668 | A1* | 3/2011 | Miyachi et al. | 123/196 R |
| 2011/0085921 | A1 | 4/2011 | Kato et al. | |
| 2011/0232594 | A1 | 9/2011 | Miyachi et al. | |
| 2012/0261009 | A1 | 10/2012 | Miyachi et al. | |

FOREIGN PATENT DOCUMENTS

| | | | |
|---|---|---|---|
| JP | 55-152973 | A | 11/1980 |
| JP | 59-180061 | U | 12/1984 |
| JP | 6-147353 | A | 5/1994 |
| JP | 7-42401 | U | 8/1995 |
| JP | 11-9910 | A | 1/1999 |
| JP | 2009-41445 | A | 2/2009 |
| JP | 2009-299573 | A | 12/2009 |

OTHER PUBLICATIONS

International Preliminary Report on Patentability (PCT/IB/338) and English Translation of Written Opinion of the International Searching Authority (PCT/ISA/237) in the corresponding International Patent Application No. PCT/JP2011/061387.

International Search Report (PCT/ISA/210) issued on Aug. 9, 2011, by the Japanese Patent Office as the International Searching Authority for International Application No. PCT/JP2011/061387.

Written Opinion (PCT/ISA/237) issued on Aug. 9, 2011, by the Japanese Patent Office as the International Searching Authority for International Application No. PCT/JP2011/061387.

* cited by examiner

OIL PRESSURE CONTROL APPARATUS

TECHNICAL FIELD

The present invention relates to an oil pressure control apparatus for controlling the pressure of oil that is ejected from a pump driven by the rotation of an engine and is supplied to constituent portions in the engine.

BACKGROUND ART

As described in PTL 1, there is a conventional oil pressure control apparatus, including: a pump that ejects oil by being driven by the rotation of an engine (an "oil pump" in this document); a valve timing control device having a driving-side rotatable member (an "outer rotor" in this document) that rotates in synchronization with a crankshaft and a following-side rotatable member (an "inner rotor" in this document) that is disposed in coaxial with the driving-side rotatable member and that rotates in synchronization with a camshaft, wherein a relative rotational phase of the following-side rotatable member with respect to the driving-side rotatable member is displaced according to supply or discharge of oil; and an engine lubricating device that lubricates constituent portions in the engine using the oil supplied by the pump.

The invention described in PTL 1 includes a flow passage area adjusting portion (a "priority valve" in this document) that, when the pressure of oil acting on the valve timing control device is low, limits the flow rate of oil from the pump to the engine lubricating device, thereby giving priority to the oil supply from the pump to the valve timing control device. Accordingly, the pressure of oil acting on the valve timing control device is ensured on a priority basis when the number of rotations of the pump is low, and, thus, the valve timing control device can be properly actuated without an electrically-driven pump for assisting the pump.

CITATION LIST

Patent Literature

PTL 1: JP 2009-299573A

SUMMARY OF INVENTION

Technical Problem

However, according to the invention described in PTL 1, the flow passage area adjusting portion is configured including a valve member and a retainer, and requires a space that allows each of the valve member and the retainer to slide. Accordingly, the size of the flow passage area adjusting portion increases, and there is room for improvement in mountability.

It is an object of the present invention to provide an oil pressure control apparatus in which the size of a flow passage area adjusting portion can be reduced, thereby having an improved mountability in an engine.

Solution to Problem

A first aspect of the present invention is directed to an oil pressure control apparatus, including: a pump that ejects oil by being driven by rotation of an engine; a first flow passage that interconnects the pump and a first predetermined portion; a second flow passage that is branched from the first flow passage and that supplies oil to a second predetermined portion, which is different from the first predetermined portion; and a flow passage area adjusting portion that is provided in the second flow passage, and that increases a flow passage area of the second flow passage when a pressure of oil in the second flow passage increases and reduces the flow passage area when the pressure of the oil decreases; wherein the flow passage area adjusting portion is configured including a spool that is formed such that a first pressure receiving face and a second pressure receiving face having an area smaller than that of the first pressure receiving face oppose each other with the second flow passage interposed therebetween, and that can move according to a pressure of oil in the second flow passage, and a biasing member that biases the spool in a direction from the first pressure receiving face to the second pressure receiving face.

With this configuration, the spool receives a force obtained by multiplying the pressure of oil in the second flow passage by a difference between the areas of the first pressure receiving face and the second pressure receiving face in a direction toward the first pressure receiving face, and a biasing force by the biasing member in a direction toward the second pressure receiving face. When the pressure of oil in the second flow passage is small, the biasing force by the biasing member predominates, the spool moves toward the second pressure receiving face, and the flow passage area of the second flow passage decreases. As the pressure of oil in the second flow passage increases, the spool moves toward the first pressure receiving face resisting the biasing force, and the flow passage area of the second flow passage increases.

Accordingly, when the pressure of oil supplied from the pump is small, the flow passage area of the second flow passage decreases, and, thus, the amount of oil supplied to the second predetermined portion (e.g., the main gallery (M/G)) can be reduced, so that a sufficient amount of oil can be supplied to the first predetermined portion. On the other hand, when the pressure of oil supplied from the pump increases, since a sufficient amount of oil has been supplied to the first predetermined portion, the amount of oil supplied to the main gallery is increased, so that constituent portions in the engine can be reliably cooled down and lubricated.

With the above-described configuration, the function of adjusting the flow passage area of the second flow passage by the flow passage area adjusting portion is realized only by moving the spool. Accordingly, compared with a conventional flow passage area adjusting portion including a spool and a retainer, the size of the flow passage area adjusting portion can be reduced, and, thus, the entire oil pressure control apparatus including this flow passage area adjusting portion can have an improved mountability in an engine.

According to a second aspect, a circumferential edge portion of the first pressure receiving face is provided with a wall portion that is projected toward the second pressure receiving face.

With the oil pressure control apparatus according to the present invention, oil that flows on the upstream side in the second flow passage flows into a flow passage space of the spool formed between the first pressure receiving face and the second pressure receiving face, and then flows out from the flow passage space to the downstream side in the second flow passage. In a state in which the spool has narrowed the flow passage area of the second flow passage, if oil that flows from the upstream side in the second flow passage into the flow passage space has a velocity component oriented toward the second pressure receiving face, when the spool moves toward the first pressure receiving face so as to increase the flow passage area, the velocity component may obstruct the movement and cause a failure in the operation of the spool.

With the above-described configuration, a circumferential edge portion of the first pressure receiving face is provided with a wall portion that is projected toward the second pressure receiving face. Accordingly, when oil flows from the upstream side in the second flow passage via a clearance between the wall portion and the valve body into the flow passage space of the spool, a velocity component oriented from the tip end of the wall portion toward the first pressure receiving face is also generated. As a result, this velocity component and the velocity component oriented toward the second pressure receiving face cancel each other. Accordingly, the spool can be properly actuated without being affected by the flow of oil.

According to a third aspect, an inner circumferential edge portion at a tip end of the wall portion is chamfered.

If an inner circumferential edge portion at the tip end of the wall portion is chamfered as in this configuration, when oil flows from the upstream side in the second flow passage via a clearance between the wall portion and the valve body into the flow passage space of the spool, a velocity component oriented from the tip end of the wall portion toward the first pressure receiving face is more easily generated. As a result, this velocity component and the velocity component oriented toward the second pressure receiving face more reliably cancel each other. Accordingly, the spool can be more reliably properly actuated without being affected by the flow of oil.

According to a fourth aspect, a valve body that accommodates the spool is provided with an inclined portion with which a flow direction of oil flowing through the second flow passage is directed toward the first pressure receiving face.

With this configuration, the inclined portion causes oil that flows on the upstream side in the second flow passage to have a velocity component oriented toward the first pressure receiving face in the flow passage space of the spool, and, thus, this velocity component and the velocity component oriented toward the second pressure receiving face cancel each other. Accordingly, the spool can be properly actuated without being affected by the flow of oil.

According to a fifth aspect, a biasing force of the biasing member is larger than a pressing force in a direction for increasing the flow passage area of the second flow passage, which is caused to act by a pressure of oil in the second flow passage while the engine is idling.

With this configuration, while the engine is idling, the biasing force by the biasing member predominates the pressing force applied by the pressure of oil in the second flow passage, and, thus, oil can be supplied to the first predetermined portion on a priority basis over the second predetermined portion. Accordingly, this configuration is preferable in the case in which the first predetermined portion requires the supply of oil immediately after start of the engine.

According to a sixth aspect, the first predetermined portion is a valve timing control device including: a driving-side rotatable member that rotates in synchronization with a crankshaft; and a following-side rotatable member that is disposed in coaxial with the driving-side rotatable member and that rotates in synchronization with a camshaft; wherein a relative rotational phase of the following-side rotatable member with respect to the driving-side rotatable member is displaced according to supply or discharge of oil.

If the first predetermined portion is the valve timing control device as in this configuration, the amount of oil supplied to the valve timing control device can be adjusted using the oil pressure control apparatus according to the present invention according to the pressure of oil in the second flow passage. As a result, the valve timing can be properly controlled, and the efficiency of the engine is improved.

According to a seventh aspect, in a case in which an oil temperature is lower than a predetermined first set temperature or is higher than a predetermined second set temperature, a control valve of the valve timing control device is switched to a predetermined valve position, so that oil is supplied from the first flow passage to a rear face of the second pressure receiving face, and the flow passage area of the second flow passage is kept in a maximum state.

For example, immediately after start of the engine, the number of rotations of the engine is low, the oil temperature is low, and, thus, the oil viscosity is high, and the oil flowability is poor. Immediately after start of the engine, the temperature in the engine main body is low, and the intake air temperature is also low, and, thus, the valve timing control device does not necessarily have to be actuated. That is to say, immediately after start of the engine, the valve timing control device does not require the oil pressure so much, whereas the main gallery requires oil for lubrication.

Thus, as in the above-described configuration, if the oil temperature is lower than a predetermined first set temperature, oil is supplied from the first flow passage to the rear face of the second pressure receiving face, and the flow passage area of the second flow passage is kept in a maximum state, and, thus, oil can be supplied to the main gallery on a priority basis.

On the other hand, if the temperature of oil becomes high, the oil viscosity decreases, and the amount of oil that leak (is exuded) from small gaps between constituent components may increase, and the oil pressure may not efficiently act on the valve timing control device. In order to actuate the valve timing control device in such a case, it is necessary to increase the size of the pump, thereby increasing the ejection pressure from the pump. That is to say, a power for driving the pump becomes necessary, and the fuel efficiency of the engine may be poor instead.

Thus, as in the above-described configuration, if the oil temperature is higher than a predetermined second set temperature, oil is supplied from the first flow passage to the rear face of the second pressure receiving face, and the flow passage area of the second flow passage is kept in a maximum state. Accordingly, the amount of oil supplied to the valve timing control device is minimized, and the pump can be suppressed from acting in vain.

Furthermore, with the above-described configuration, the control valve of the valve timing control device is used in order to supply oil from the first flow passage to the rear face of the second pressure receiving face, and, thus, a dedicated switch valve is not necessary, and an oil pressure control apparatus that is advantageous in terms of the cost and the mountability can be obtained.

According to an eighth aspect, in a case in which an oil temperature is higher than a predetermined second set temperature, a thermosensor control portion including thermowax that is expanded according to an increase in the temperature is actuated, so that oil is supplied from the second flow passage to a rear face of the second pressure receiving face, and the flow passage area of the second flow passage is kept in a maximum state.

For example, in the case in which the first predetermined portion is the valve timing control device, as described above, it is desirable that the amount of oil supplied to the valve timing control device is minimized if the temperature of oil becomes high. With this configuration, if the oil temperature is higher than a predetermined second set temperature, oil is supplied from the second flow passage to the rear face of the second pressure receiving face, and the flow passage area of the second flow passage is kept in a maximum state. Accordingly, the amount of oil supplied to the valve timing control device is minimized, and the pump can be suppressed from acting in vain.

Furthermore, with the above-described configuration, the thermosensor control portion is actuated by the thermowax. Thus, for example, compared with an electrical configuration including a temperature sensor and an electrically-driven actuator, the configuration is not complicated, and the apparatus seldom breaks down. Furthermore, since this configuration depends on the properties of a material, the displacement is to some extent unambiguously, and the reliability of the displacement is high regardless of the simple configuration. Furthermore, with this configuration, the thermosensor control portion only has the function of switching the oil passages, and, thus, large displacement does not have to occur in the thermosensor control portion, and the size of the oil pressure control apparatus can be reduced.

According to a ninth aspect, in the thermosensor control portion, an arrangement space containing a thermosensor main body portion that accommodates the thermowax is provided with an oil supply passage that supplies oil from the second flow passage.

With this configuration, oil is supplied from the second flow passage to the arrangement space containing the thermosensor main body portion that accommodates the thermowax, and, thus, the oil temperature is easily transmitted to the thermowax, and the sensitivity of the thermosensor control portion to a change in the oil temperature is improved. Accordingly, a situation can be avoided in which, although the oil temperature becomes higher than the second set temperature, the thermosensor control portion is not actuated, so that oil is continuously supplied to the first predetermined portion, and the pump acts in vain.

According to a tenth aspect, an oil return passage through which oil flows from the arrangement space to a downstream side in the second flow passage is provided.

With this configuration, the flow of oil is established from the second flow passage via the arrangement space and back to the downstream side in the second flow passage. Accordingly, oil having the function of transmitting heat to the thermowax accommodated in the thermosensor main body portion is supplied to the second predetermined portion as it is, and, thus, oil is not wasted. Furthermore, a situation can be avoided in which the oil pressure in the arrangement space becomes too large, so that a large load is applied to constituent components of the thermosensor control portion.

According to an eleventh aspect, a cup-shaped thermosensor accommodating member covers the thermosensor main body portion that is provided on a placement face of a valve body, and a clearance is formed between an end face of the thermosensor accommodating member and the placement face.

With this configuration, merely with a configuration in which a dimensional relationship between the thermosensor accommodating member and the thermosensor main body portion is properly set and a clearance is provided between the end face of the thermosensor accommodating member and the placement face, oil can be supplied via this clearance to the arrangement space. Accordingly, complex oil passages do not have to be formed in order to supply oil to the arrangement space, the configuration of the thermosensor control portion can be made simple.

According to a twelfth aspect, the thermosensor main body portion is provided with a movable member that supports the thermosensor accommodating member and that is projected when the thermowax is expanded, and, in a case in which the thermosensor accommodating member is moved according to the projection of the movable member, a ring-shaped oil passage formed on an outer circumferential face of the thermosensor accommodating member is interconnected to the second flow passage, so that oil is supplied to a rear face of the second pressure receiving face.

With this configuration, the thermosensor accommodating member is moved at the same time when the thermowax is expanded and the movable member is projected, and oil is supplied to the rear face of the second pressure receiving face. Accordingly, if the oil temperature becomes higher than the second set temperature, the flow passage area of the second flow passage can be set more promptly at a maximum state. Furthermore, constituent components such as a temperature sensor and an electrically-driven actuator are not necessary in order to realize this configuration, and, thus, a configuration that is advantageous in terms of the mountability and the cost can be obtained.

According to a thirteenth aspect, in a state in which the spool has narrowed the second flow passage to a minimum, oil that flows on an upstream side in the second flow passage can flow into a flow passage space formed between the first pressure receiving face and the second pressure receiving face, and cannot flow out from the flow passage space to a downstream side in the second flow passage.

With this configuration, in a state in which the spool has narrowed the second flow passage to a minimum, oil does not flow from the flow passage space to the downstream side in the second flow passage. That is to say, in this state, the upstream side and the downstream side in the second flow passage with respect to the flow passage area adjusting portion are interconnected to each other only via one path through the heat transmission oil passage, the arrangement space, and the oil return passage. Accordingly, compared with a case in which a plurality of paths are present, the pressure of oil supplied to the second predetermined portion can be easily adjusted.

DESCRIPTION OF EMBODIMENTS

Hereinafter, embodiments in which the present invention has been applied as an oil pressure control apparatus for an automobile engine will be described with reference to the drawings. In the embodiments, a description will be given assuming that a "first predetermined portion" in the present invention is a valve timing control device on the intake valve side.

[First Embodiment]

1. Overall Configuration

Figure 1:
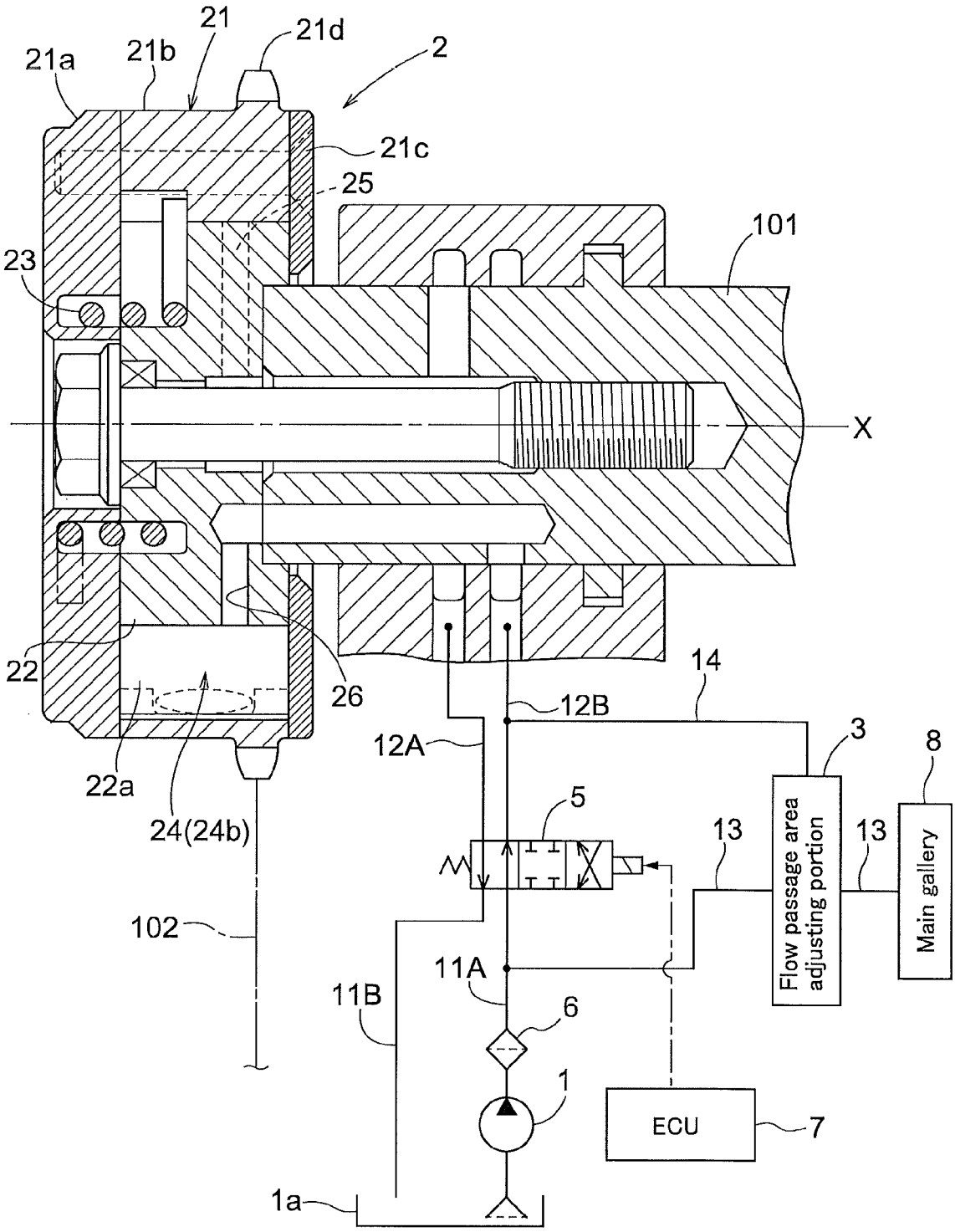
FIG. 1 is a view showing the overall configuration of an oil pressure control apparatus according to a first embodiment of the present invention.

As shown in FIG. 1, an oil pressure control apparatus includes a pump 1 that is driven by the rotation of an engine and a valve timing control device 2 that displaces a relative rotational phase according to supply or discharge of oil. The valve timing control device 2 operates according to supply or discharge of oil that is controlled by an OCV (oil control valve) 5 as a "control valve". The pump 1 and the OCV 5 are connected to each other via an oil ejection passage 11A as a "first flow passage", and the valve timing control device 2 and the OCV 5 are connected to each other via an advance oil passage 12A and a retard oil passage 12B. The oil ejection passage 11A branches into a lubricating oil passage 13 as a "second flow passage" that supplies oil to a main gallery 8 as a "second predetermined portion". The lubricating oil passage 13 is provided with a flow passage area adjusting portion 3 that adjusts the flow passage area. Note that the oil passages are formed in cylinder cases or the like in the engine.

2. Pump

When the rotational driving force of a crankshaft (not shown) is transmitted, the pump 1 is mechanically driven to eject oil. As shown in FIG. 1, the pump 1 pumps oil stored in an oil pan 1*a*, and ejects the oil into the oil ejection passage 11A. The oil ejection passage 11A is provided with an oil filter 6 that filters out minute dust and sludge that have not been removed by an oil strainer. The oil after filtering through the oil filter 6 is supplied to the valve timing control device 2 and the main gallery 8. Note that the main gallery 8 refers to the entire slidable members such as pistons, cylinders, and crankshaft bearings (not shown).

The oil discharged from the valve timing control device 2 is returned via the OCV 5 and an oil return passage 11B to the oil pan 1*a*. The oil that has been supplied to the main gallery 8 is transmitted via its cover (not shown) and the like and is recovered to the oil pan 1*a*. Also, oil that leaks from the valve timing control device 2 is transmitted via its cover and the like and is recovered to the oil pan 1*a*.

3. Valve Timing Control Device

[Summary]

Figure 2:
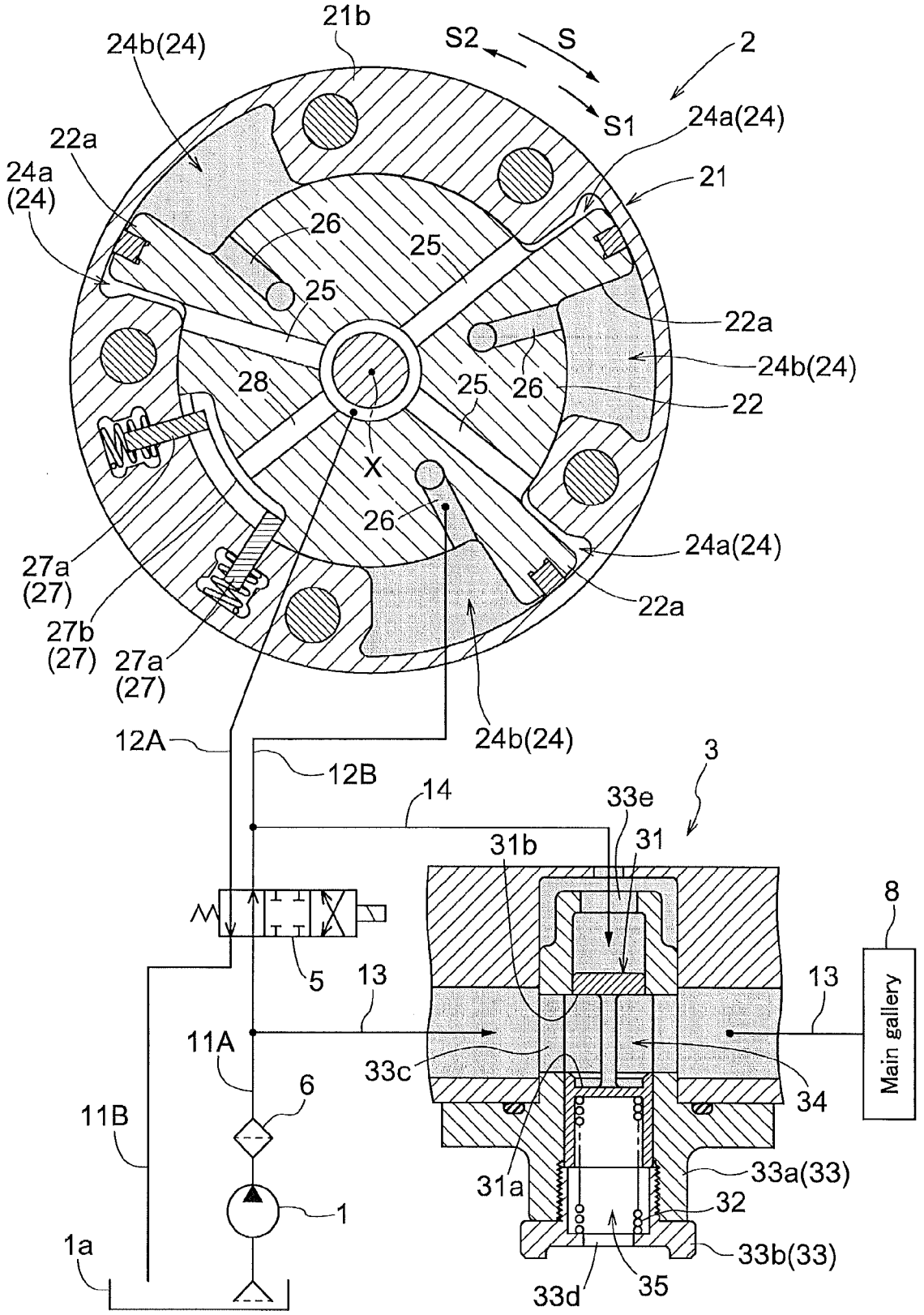
FIG. 2 is a cross-sectional view showing a state of the oil pressure control apparatus when the oil temperature is lower than a first set temperature T1 or is higher than a second set temperature T2.

As shown in FIG. 1, the valve timing control device 2 includes a housing 21 as a "driving-side rotatable member" that rotates in synchronization with the crankshaft (not shown) of the engine, and an inner rotor 22 as a "following-side rotatable member" that is disposed in coaxial with the housing 21 on an axis X and that rotates in synchronization with a camshaft 101. As shown in FIG. 2, the valve timing control device 2 includes a lock mechanism 27 that can lock a relative rotational phase of the inner rotor 22 with respect to the housing 21 at a most retarded phase by locking a relative rotation of the inner rotor 22 with respect to the housing 21.

[Housing and Inner Rotor]

As shown in FIG. 1, the inner rotor 22 is disposed at a tip end portion of the camshaft 101. The housing 21 includes a front plate 21*a* that is on a side opposite the side on which the camshaft 101 is connected, an outer rotor 21*b* that integrally includes a timing sprocket 21*d*, and a rear plate 21*c* that is on the side on which the camshaft 101 is connected. The outer rotor 21*b* is attached from the outside to the inner rotor 22, and is sandwiched between the front plate 21*a* and the rear plate 21*c*. The front plate 21*a*, the outer rotor 21*b*, and the rear plate 21*c* are bolted on each other.

When the crankshaft is rotationally driven, the rotational driving force is transmitted via a power transmission member 102 to the timing sprocket 21*d*, and the housing 21 is rotationally driven in a rotational direction S shown in FIG. 2. When the housing 21 is rotationally driven, the inner rotor 22 is rotationally driven in the rotational direction S to rotate the camshaft 101, and a cam provided on the camshaft 101 depresses and opens an intake valve of the engine.

As shown in FIG. 2, the outer rotor 21*b* and the inner rotor 22 define three fluid pressure chambers 24. A plurality of vanes 22*a* that are projected from the inner rotor 22 in outer radial directions are formed away from each other along the rotational direction S so as to be positioned in the fluid pressure chambers 24. The fluid pressure chambers 24 are each partitioned by the vane 22*a* into an advance chamber 24*a* and a retard chamber 24*b* in the rotational direction S.

As shown in FIGS. 1 and 2, advance chamber interconnecting passages 25 are formed through the inner rotor 22 and the camshaft 101 so as to be interconnected to the respective advance chambers 24*a*. Furthermore, retard chamber interconnecting passages 26 are formed through the inner rotor 22 and the camshaft 101 so as to be interconnected to the respective retard chambers 24*b*. As shown in FIG. 1, the advance chamber interconnecting passages 25 are connected to the advance oil passage 12A that is in interconnection with the OCV 5. The retard chamber interconnecting passages 26 are connected to the retard oil passage 12B that is in interconnection with the OCV 5.

As shown in FIG. 1, a torsion spring 23 is provided between the inner rotor 22 and the front plate 21*a*. The torsion spring 23 biases the inner rotor 22 to the advance side resisting an average displacement force in the retard direction based on a cam torque variation. Accordingly, the relative rotational phase can be smoothly and promptly displaced in an advance direction S1 (described later).

[Lock Mechanism]

When the pressure of oil is not stable immediately after start of the engine, the lock mechanism 27 locks the relative rotational phase at the most retarded phase by holding the housing 21 and the inner rotor 22 at predetermined relative positions. As a result, the engine can be properly started, and no backlash of the inner rotor 22 is caused by a displacement force based on a cam torque variation at the time of start or during idle running of the engine.

As shown in FIG. 2, the lock mechanism 27 includes two plate-shaped lock members 27*a*, a lock groove 27*b*, and a lock mechanism interconnecting passage 28. The lock groove 27*b* is formed on an outer circumferential face of the inner rotor 22, and has a constant width in a relative rotational direction. The lock members 27*a* are provided in accommodating portions that are formed in the outer rotor 21*b*, and can be projected into and withdrawn from the lock groove 27*b* in the radial directions. The lock members 27*a* are always biased by springs in radially inward directions, that is, toward the lock groove 27*b*. The lock mechanism interconnecting passage 28 connects the lock groove 27*b* and the advance chamber interconnecting passages 25. Accordingly, when oil is supplied to the advance chambers 24*a*, oil is supplied also to the lock groove 27*b*, and, when oil is discharged from the advance chambers 24*a*, oil is discharged also from the lock groove 27*b*.

Figure 3:
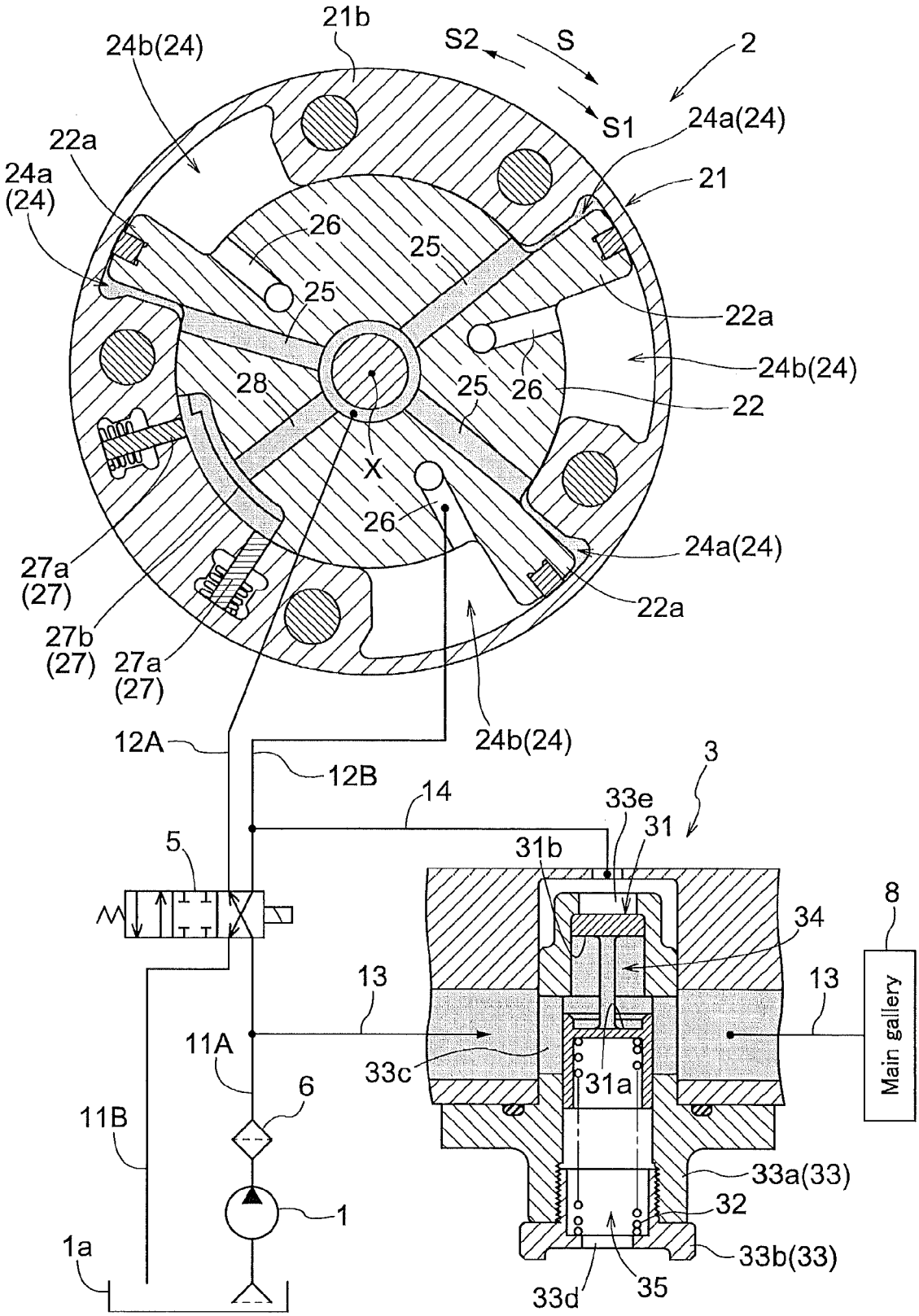
FIG. 3 is a cross-sectional view showing a state of the oil pressure control apparatus when the oil temperature is between the first set temperature T1 and the second set temperature T2, and the number of rotations of the engine is low.

When oil has been discharged from the lock groove 27*b*, the lock members 27*a* can be projected into the lock groove 27*b*. As shown in FIG. 2, when both lock members 27*a* have been projected into the lock groove 27*b*, the lock members 27*a* are simultaneously caught respectively at both ends in the circumferential direction of the lock groove 27*b*. As a result, the relative rotation of the inner rotor 22 with respect to the housing 21 is locked, and the relative rotational phase is locked at the most retarded phase. When oil is supplied to the lock groove 27*b*, as shown in FIG. 3, both lock members 27*a* are withdrawn from the lock groove 27*b* to cancel the lock of the relative rotational phase, and, thus, the inner rotor 22 is allowed to relatively rotate. Hereinafter, the state in which the lock mechanism 27 has locked the relative rotational phase at the most retarded phase is referred to as a "locked state". Furthermore, the state in which the locked state has been cancelled is referred to as an "unlocked state".

4. OCV (control valve)

The OCV 5 is of an electromagnetic control type, and can perform control of oil between supply, discharge, and block of supply and discharge to and from the advance chamber interconnecting passages 25 and the retard chamber interconnecting passages 26. The OCV 5 is configured as a spool type, and operates according to an ECU 7 (engine control unit) controlling the amount of electricity fed. The OCV 5 can perform control such as supplying oil to the advance oil passage 12A and discharging oil from the retard oil passage 12B, discharging oil from the advance oil passage 12A and supplying oil to the retard oil passage 12B, and blocking supply and discharge of oil to and from the advance oil passage 12A and the retard oil passage 12B.

The control that supplies oil to the advance oil passage 12A and discharges oil from the retard oil passage 12B is "advance control". When the advance control is performed, the vanes 22*a* relatively rotate with respect to the outer rotor 21*b* in the advance direction S1, and the relative rotational phase is displaced to the advance side. The control that discharges oil from the advance oil passage 12A and supplies oil to the retard oil passage 12B is "retard control". When the retard control is performed, the vanes 22*a* relatively rotate with respect to the outer rotor 21*b* in a retard direction S2, and the relative rotational phase is displaced to the retard side. When the control that blocks supply and discharge of oil to and from the advance oil passage 12A and the retard oil passage 12B is performed, the relative rotational phase can be kept at any phase.

Note that setting are made such that the advance control can be performed when electricity is fed to the OCV 5, and the retard control can be performed when the feeding of electricity to the OCV 5 is stopped. Furthermore, the opening degree of the OCV 5 is set by adjusting the duty cycle of electrical power supplied to the electromagnetic solenoid. Accordingly, the amount of oil supplied and discharged can be fine-adjusted.

In this manner, the OCV 5 is controlled such that oil is supplied and discharged to and from the advance chambers 24*a* and the retard chambers 24*b*, and the amount of oil supplied and discharged is fixed, and causes the pressure of the oil to act on the vanes 22*a*. Accordingly, the relative rotational phase is displaced in the advance direction or the retard direction, or kept at any phase.

5. Operation of the Valve Timing Control Device

Hereinafter, an operation of the valve timing control device 2 will be described with reference to FIGS. 2 to 5. With the above-described configuration, the inner rotor 22 can relatively rotate with respect to the housing 21 smoothly about the axis X in a constant range. The constant range in which the inner rotor 22 can relatively rotate with respect to the housing 21, that is, a phase difference between the most advanced phase and the most retarded phase corresponds to a range in which each vane 22*a* can be displaced within the fluid pressure chamber 24. Note that the most retarded phase makes the volume of the retard chambers 24*b* largest, and the most advanced phase makes the volume of the advance chambers 24*a* largest.

Although not shown, a crank angle sensor that detects the rotating angle of the crankshaft of the engine and a camshaft angle sensor that detects the rotating angle of the camshaft 101 are provided. The ECU 7 detects the relative rotational phase from the detection results from the crank angle sensor and the camshaft angle sensor, and determines a phase at which the relative rotational phase is set. Furthermore, the ECU 7 is provided with a signal system that acquires ON/OFF information of an ignition key, information from an oil temperature sensor that detects oil temperature, and the like. Furthermore, a memory of the ECU 7 stores control information of optimum relative rotational phases according to running states of the engine. The ECU 7 controls the relative rotational phase based on information on the running state (engine rotational velocity, coolant temperature, etc.) and the above-described control information.

As shown in FIG. 2, the lock mechanism 27 maintains the locked state before start of the engine. When an ignition key (not shown) is turned on, cranking is started, the engine is started in a state in which the relative rotational phase is locked at the most retarded phase. Then, the mode is shifted to idle running, and catalyst warm-up is started. When the catalyst warm-up ends and an accelerator (not shown) is depressed, electricity is fed to the OCV 5 and the advance control is performed so as to displace the relative rotational phase in the advance direction S1. Accordingly, oil is supplied to the advance chambers 24*a* and the lock groove 27*b*, and, as shown in FIG. 3, the lock members 27*a* are withdrawn from the lock groove 27*b* to provide an unlocked state. In the unlocked state, the relative rotational phase can be displaced, and is displaced to the states in FIGS. 4 and 5 according to the oil supply to the advance chambers 24*a*. Subsequently, the relative rotational phase is displaced between the most advanced phase and the most retarded phase according to the load, the rotational velocity, and the like of the engine.

Before stopping the engine, the mode has been set to idle running, and, thus, the relative rotational phase is at the most retarded phase. At that time, at least the lock member 27*a* on the advance side is projected into the lock groove 27*b*. Then, when the ignition key is turned off, backlash of the inner rotor 22 is caused by a cam torque variation, and, thus, the lock member 27*a* on the retard side is also projected into the lock groove 27*b*, and the locked state is provided. Accordingly, the engine can be properly started next time.

6. Flow Passage Area Adjusting Portion

Hereinafter, the flow passage area adjusting portion 3 will be described in detail with reference to FIG. 6. The flow passage area adjusting portion 3 is configured including a spool 31 that can move in directions orthogonal to the lubricating oil passage 13. The spool 31 is formed such that a first pressure receiving face 31*a* and a second pressure receiving face 31*b* in the shape of discs that receive the pressure of oil in the lubricating oil passage 13 oppose each other with the lubricating oil passage 13 interposed therebetween. The first pressure receiving face 31*a* and the second pressure receiving face 31*b* are coupled via a columnar coupling portion 31*c*, and, thus, the spool 31 has a cross-section in the shape of an I. A space around the coupling portion 31*c* is configured as a flow passage space 34 through which oil in the lubricating oil passage 13 can flow.

Between the rear face of the first pressure receiving face 31*a* and the valve body 33, a spring accommodating space 35 is formed in which a spring 32 is accommodated as a "biasing member" and always biases the spool 31 in a direction from the first pressure receiving face 31*a* to the second pressure receiving face 31*b*. The valve body 33 is configured by a body main body 33*a* and a stopper member 33*b*. The stopper member 33*b* is screwed onto one end portion of the body main body 33*a* in a state in which the spool 31 and the spring 32 are accommodated inside the body main body 33*a*. The outer diameter of the spool 31 is substantially equal to the inner diameter of the body main body 33*a*. A side wall of the body main body 33*a* is provided with two flow opening portions 33*c* that are connected to the lubricating oil passage 13, and the flow passage area of the lubricating oil passage 13 is adjusted by causing the spool 31 accommodated in the valve body 33 to be projected into and withdrawn from the lubricating oil passage 13.

A breather hole 33*d* is formed in an end portion of the valve body 33 on the side of the first pressure receiving face 31*a*. If the spring accommodating space 35 is configured as a hermetically-sealed space, the spool 31 cannot smoothly move toward the first pressure receiving face 31*a*, which may obstruct the operation of the spool 31. Thus, if the spring accommodating space 35 is opened to the outside by forming the breather hole 33*d*, the spool 31 can be smoothly actuated.

An operating opening portion 33*e* is formed in an end portion of the valve body 33 on the side of the second pressure receiving face 31*b*. As shown in FIGS. 1 to 5, an operating oil passage 14 branched from the retard oil passage 12B is connected to the operating opening portion 33*e*, and oil in the operating oil passage 14 is supplied to the rear face of the second pressure receiving face 31*b*. It is when the retard control is being performed that oil is supplied to the operating oil passage 14.

The spool 31 is configured such that the area of the first pressure receiving face 31*a* is larger than the area of the second pressure receiving face 31*b*. Accordingly, the spool 31 receives a force calculated following the formula "[Pressure of oil in the lubricating oil passage 13]×[(Area of the first pressure receiving face 31*a*)−(Area of the second pressure receiving face 31*b*)]" (hereinafter, referred to as a "force Fs") in a direction from the second pressure receiving face 31*b* to the first pressure receiving face 31*a*, and a biasing force of the spring 32 (hereinafter, referred to as a "biasing force Fp") in a direction from the second pressure receiving face 31*b* to the first pressure receiving face 31*a*. When the pressure of oil in the lubricating oil passage 13 increases and the force Fs becomes larger than the biasing force Fp, the spool 31 starts to move in a direction from the second pressure receiving face 31*b* to the first pressure receiving face 31*a*.

Figure 4:
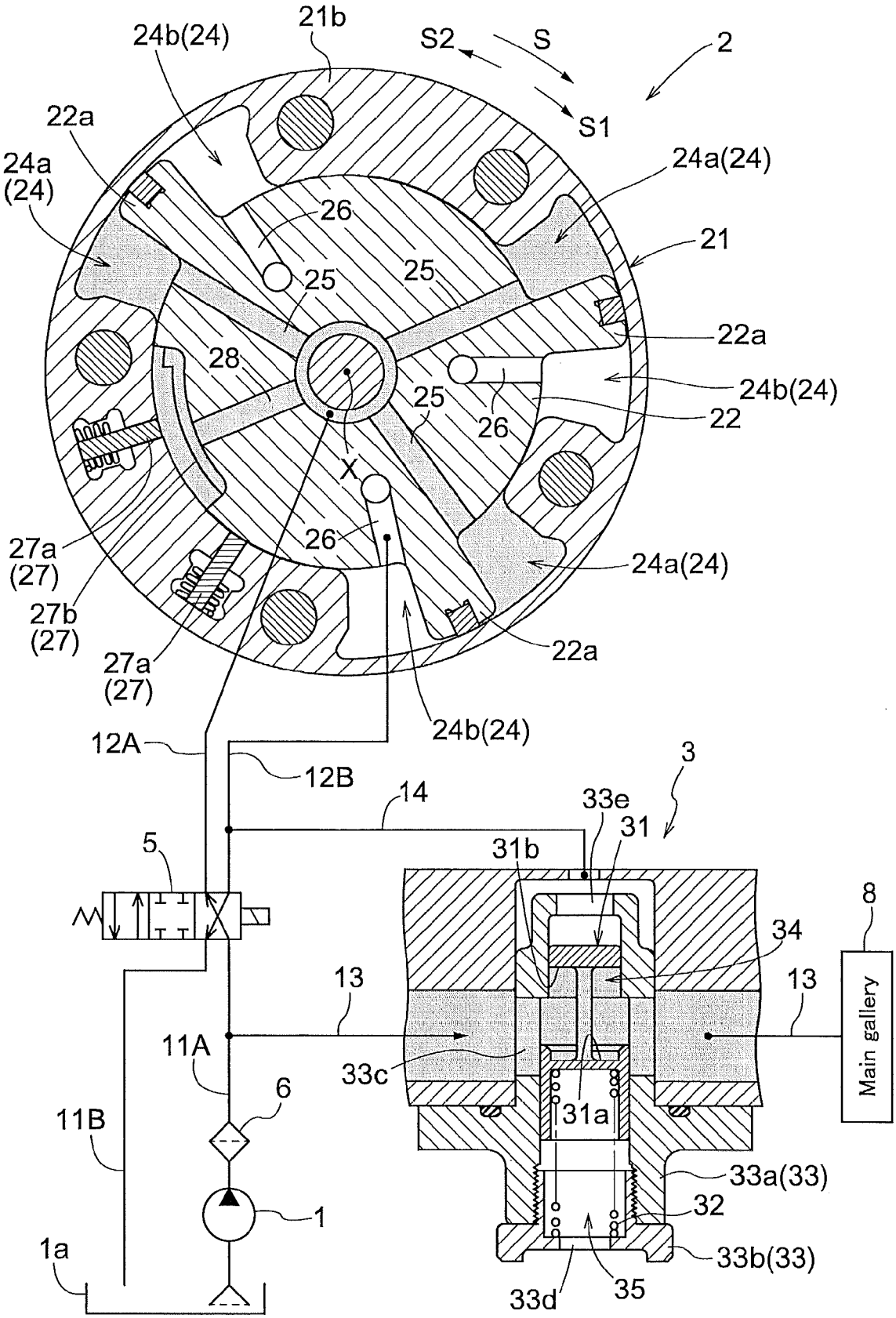
FIG. 4 is a cross-sectional view showing a state of the oil pressure control apparatus when the oil temperature is between the first set temperature T1 and the second set temperature T2, and the number of rotations of the engine is in the course of increasing.
Figure 5:
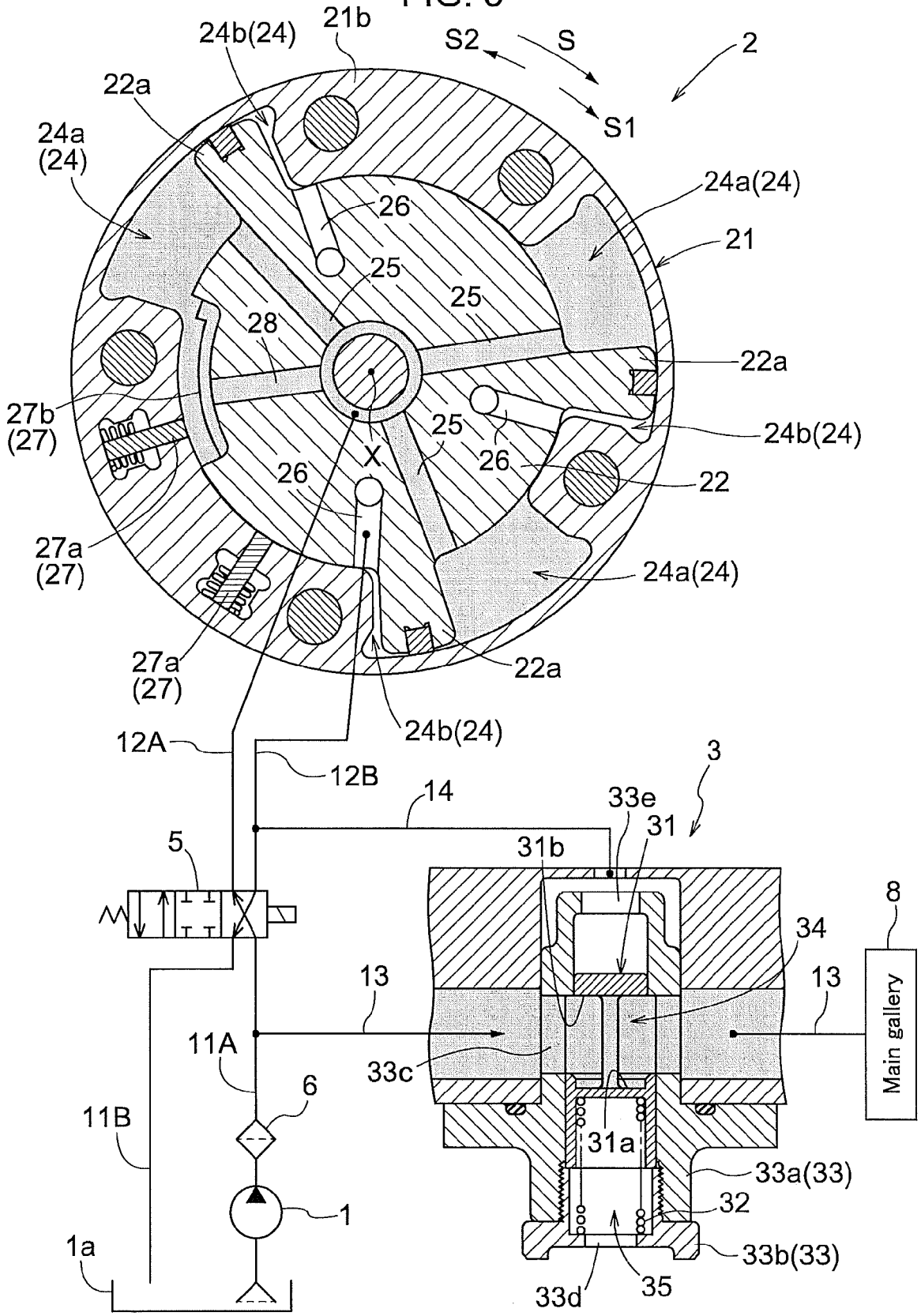
FIG. 5 is a view showing a state of the oil pressure control apparatus when the oil temperature is between the first set temperature T1 and the second set temperature T2, and the number of rotations of the engine is high.

In this manner, with the action of the pressure of oil in the lubricating oil passage 13, the spool 31 can slide, at a maximum, between the state shown in FIG. 3 in which the end portion of the spool 31 on the side of the second pressure receiving face 31*b* abuts against the body main body 33*a* and the state in FIG. 5 in which the end portion of the spool 31 on the side of the first pressure receiving face 31*a* abuts against the stopper member 33*b*. In the state in FIG. 3, the flow passage area of the lubricating oil passage 13 is narrowed to a minimum, and, in the state in FIG. 5, the lubricating oil passage 13 is fully opened. FIG. 4 shows a state during the shift from the state in FIG. 3 to the state in FIG. 5.

Furthermore, when the pressure of oil in the operating oil passage 14 acts on the spool 31, the rear face of the second pressure receiving face 31*b* receives a force in a direction from the second pressure receiving face 31*b* to the first pressure receiving face 31*a*. The pressure of oil in the operating oil passage 14 acts on the entire rear face of the second pressure receiving face 31*b*, and, thus, a large force can be easily generated, and the lubricating oil passage 13 can be reliably kept in the fully opened state resisting the biasing force Fp as shown in FIG. 2.

As described above, with the action of the pressure of oil in the lubricating oil passage 13 or the action of the pressure of oil in the lubricating oil passage 13 and the pressure of oil in the operating oil passage 14, the spool 31 slides inside the valve body 33, and the flow passage area of the lubricating oil passage 13 is adjusted. That is to say, the function of adjusting the flow passage area of the lubricating oil passage 13 by the flow passage area adjusting portion 3 is realized only by moving the spool 31. Accordingly, compared with a conventional flow passage area adjusting portion including a spool and a retainer, the size of the flow passage area adjusting portion 3 can be reduced, and, thus, the entire oil pressure control apparatus can have an improved mountability in the engine.

Figure 6:
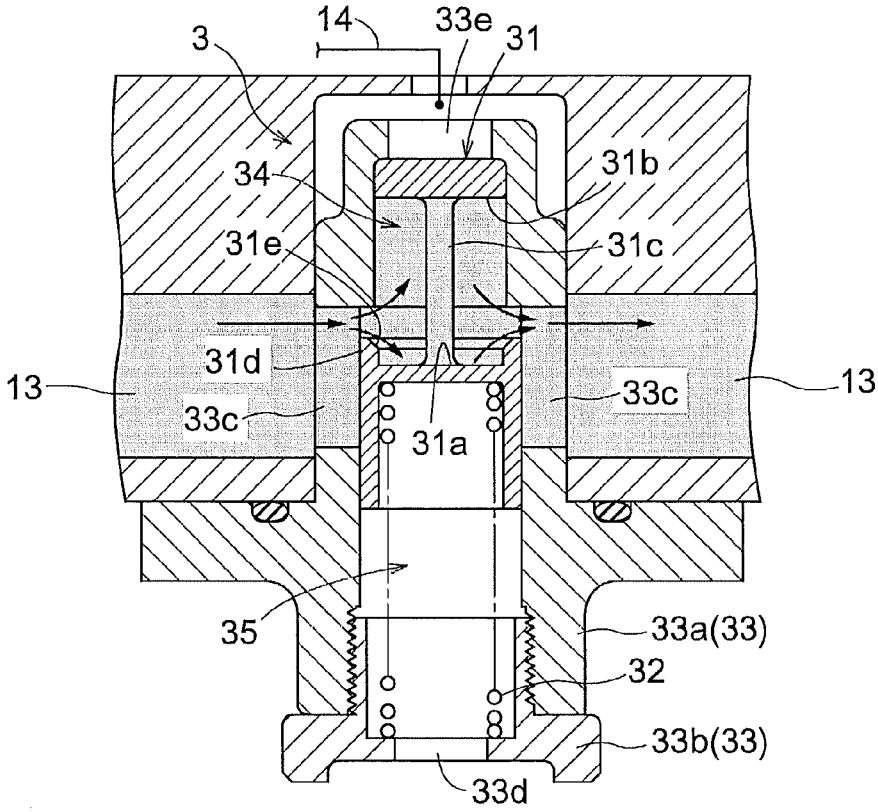
FIG. 6 is a cross-sectional view showing the details of a flow passage area adjusting portion.

In a state in which the spool 31 has narrowed the flow passage area of the lubricating oil passage 13 as shown in FIG. 6, if oil that flows from the upstream side in the lubricating oil passage 13 into the flow passage space 34 has a velocity component oriented toward the second pressure receiving face 31*b*, when the spool 31 moves toward the first pressure receiving face 31*a* so as to increase the flow passage area, the velocity component may obstruct the movement and cause a failure in the operation of the spool 31.

Thus, in this embodiment, as shown in FIG. 6, a circumferential edge portion of the first pressure receiving face 31*a* is provided with a wall portion 31*d* that is projected toward the second pressure receiving face 31*b*. Accordingly, when oil flows from the upstream side in the lubricating oil passage 13 via a clearance between the wall portion 31*d* and the valve body 33 into the flow passage space 34, a velocity component oriented toward the first pressure receiving face 31*a* and a velocity component oriented toward the second pressure receiving face 31*b* are generated. As a result, these velocity components cancel each other.

Furthermore, in this embodiment, an inner circumferential edge portion at a tip end of the wall portion 31*d* is chamfered to form a tapered face 31*e*. Accordingly, when oil flows from the upstream side in the lubricating oil passage 13 via a clearance between the wall portion 31*d* and the valve body 33 into the flow passage space 34, a velocity component oriented from the tip end of the wall portion 31*d* toward the first pressure receiving face 31*a* is more easily generated. As a result, this velocity component and the velocity component oriented toward the second pressure receiving face 31*b* more reliably cancel each other. Accordingly, the spool 31 can be more reliably properly actuated without being affected by the flow of oil.

Figure 7:
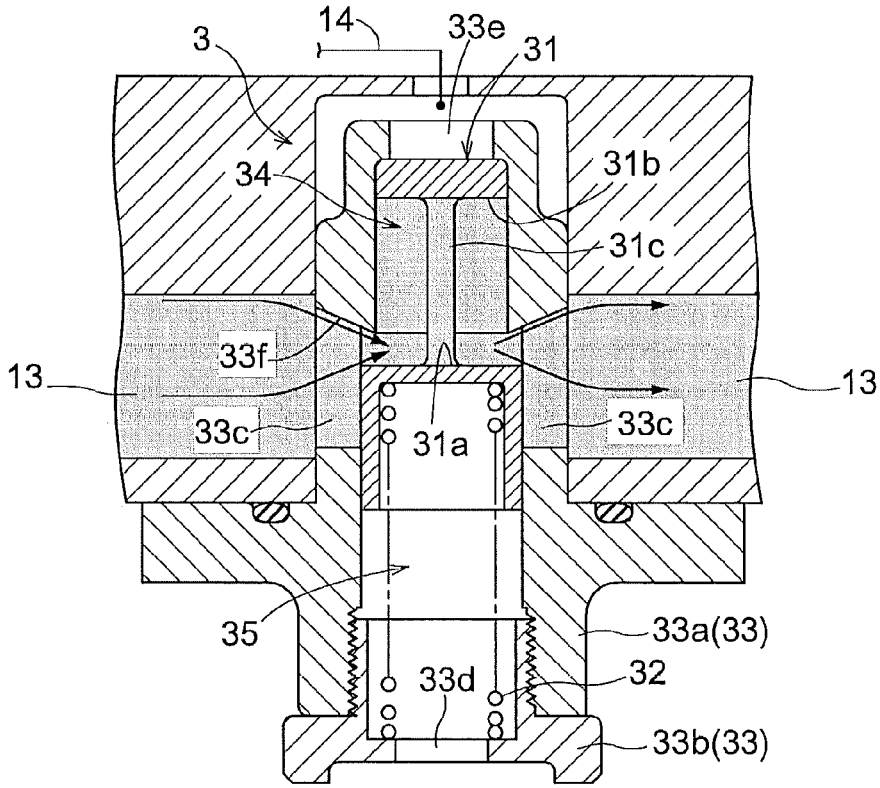
FIG. 7 is a cross-sectional view showing the details of a flow passage area adjusting portion according to another embodiment.

Instead of providing the wall portion 31*d*, or, in addition to providing the wall portion 31*d*, it is also possible to provide an inclined portion 33*f* on the valve body 33 as shown in FIG. 7. Since the inclined portion 33*f* causes oil that flows on the upstream side in the lubricating oil passage 13 to have a velocity component oriented toward the first pressure receiving face 31*a* in the flow passage space 34, this velocity component and the velocity component oriented toward the second pressure receiving face 31*b* cancel each other. Accordingly, the spool 31 can be properly actuated without being affected by the flow of oil.

Note that, giving priority to ease in processing, the wall portion 31*d* and the inclined portion 33*f* shown in FIGS. 6 and 7 are formed over the entire circumference. However, the wall portion 31*d* and the inclined portion 33*f* do not necessarily have to be formed over the entire circumference, and, for example, they may be formed only on the upstream side in the lubricating oil passage 13. Furthermore, if there is no possibility of a failure in the operation of the spool 31 being caused by the flow of oil in the flow passage space 34, the wall portion 31*d* or the inclined portion 33*f* does not have to be formed. The same is applied to a second embodiment (described later).

7. Operation of the Oil Pressure Control Apparatus

Hereinafter, an operation of the oil pressure control apparatus will be described with reference to the drawings. Note that "II", "III", "IV", and "V" in FIGS. 8(*a*) to 8(*c*) respectively correspond to the states in FIGS. 2, 3, 4, and 5.

Figure 8A:
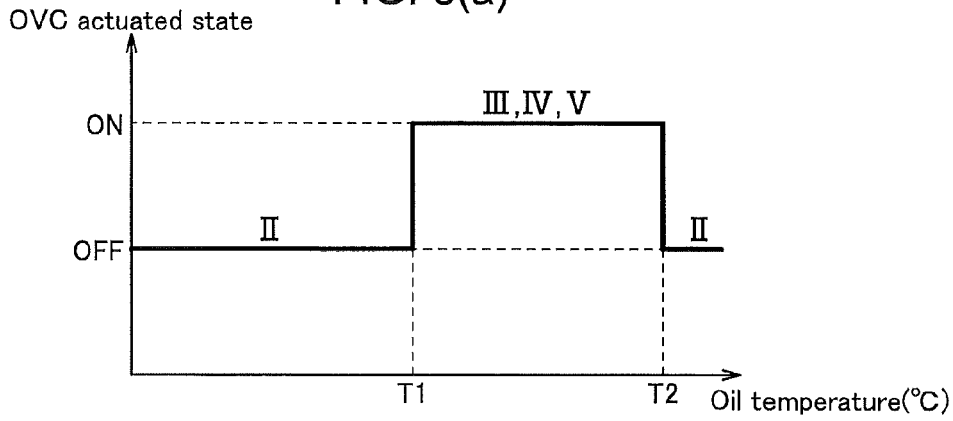
FIG. 8(*a*) shows a graph of a relationship between the oil temperature and the ON/OFF state of an OCV, FIG. 8(*b*) shows graphs of relationships between the number of rotations of an engine and the pressure of oil on constituent portions when the oil temperature is lower than the first set temperature T1 or is higher than the second set temperature T2, and FIG. 8(*c*) shows graphs of relationships between the number of rotations of an engine and the pressure of oil on constituent portions when the oil temperature is between the first set temperature T1 and the second set temperature T2.
Figure 8B:
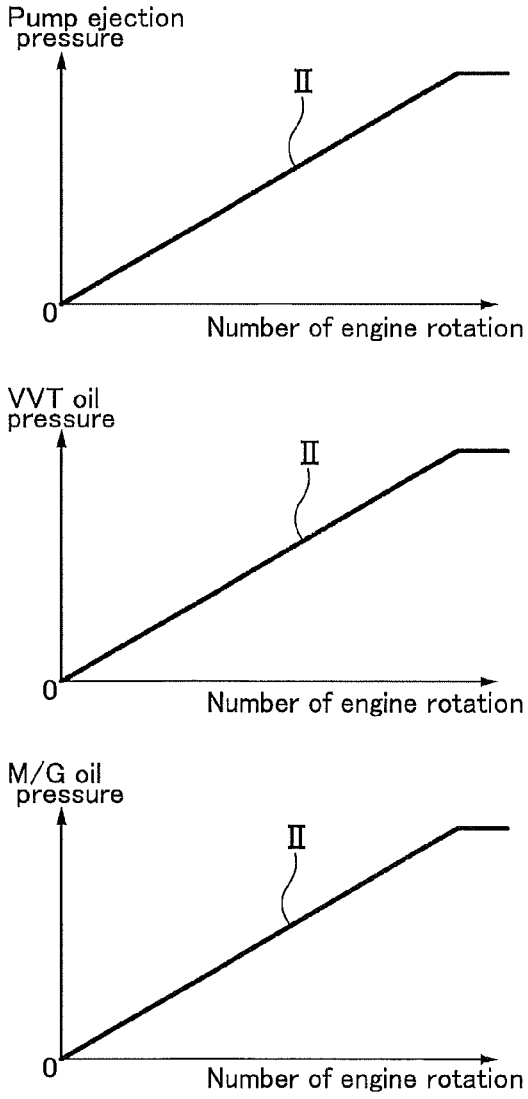
Figure 8C:
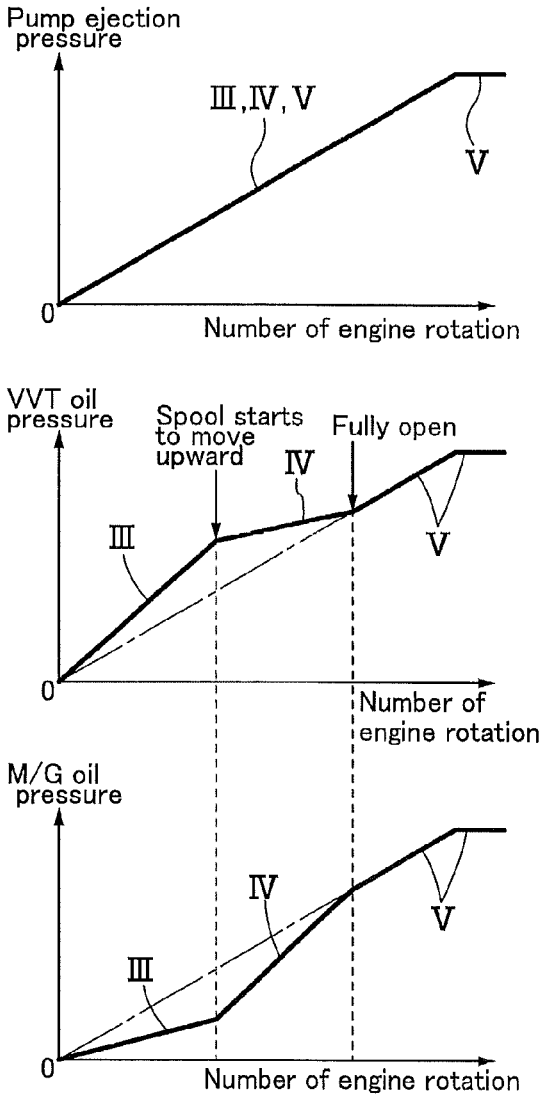

Immediately after start of the engine, the valve timing control device 2 does not have to be actuated, and does not require the oil pressure. On the other hand, the main gallery 8 requires oil as lubricating oil in order to start the operation. Thus, if the oil temperature is lower than a predetermined first set temperature T1, electricity is not fed to the OCV 5 (OFF), as shown in FIG. 8(*a*). That is to say, as shown in FIG. 2, the OCV 5 is kept at the retard control state, the retard oil passage 12B is connected to the oil ejection passage 11A, and the advance oil passage 12A is connected to the oil return passage 11B. In this state, even when cranking is started and warm-up is then started, immediately after start of the engine, the number of rotations of the engine is low, and the oil temperature is also low. Accordingly, the pressure of oil in the ejection flow passage is low, and the pressure of oil in the lubricating oil passage 13 will naturally become low, and, thus, the spool 31 is not actuated by the pressure of oil in the lubricating oil passage 13. However, on the other hand, although the valve timing control device 2 is in the locked state, oil is supplied to the retard chambers 24*b*, and the pressure of oil in the retard oil passage 12B increases. This oil with an increased pressure is supplied via the operating oil passage 14 to the rear face of the second pressure receiving face 31*b*, and the spool 31 moves toward the first pressure receiving face 31*a*. As a result, the lubricating oil passage 13 is fully opened, and oil is supplied to the main gallery 8 on a priority basis.

FIG. 8(*b*) shows relationships between the pressure of oil ejected from the pump 1, the pressure of oil supplied to the valve timing control device 2, and the pressure of oil supplied to the main gallery 8 at that time. As shown in the graphs, the pressure of oil supplied to the valve timing control device 2 and the pressure of oil supplied to the main gallery 8 both follow an increase in the pressure of oil ejected from the pump 1.

After the oil temperature becomes higher than the predetermined first set temperature T1 and the warm-up has been completed, if the accelerator is depressed, electricity is fed to the OCV 5 (ON), and the mode is shifted to an advance control state. Accordingly, the oil pressure is required in order to stably start the valve timing control device 2. However, since the OCV 5 is in the advanced state, the advance oil passage 12A is connected to the oil ejection passage 11A, and the retard oil passage 12B is connected to the oil return passage 11B. Accordingly, the pressure of oil in the operating oil passage 14 is rapidly lowered. Furthermore, even if the oil temperature increases, the number of rotations of the engine is low, and, thus, the pressure of oil ejected from the pump 1 is still low, and the pressure of oil acting on the lubricating oil passage 13 is low. Thus, as shown in FIG. 3, the spool 31 is biased by the spring 32 to be moved toward the second pressure receiving face 31*b*, and the flow passage area of the lubricating oil passage 13 is narrowed to a minimum. As a result, oil is supplied to the valve timing control device 2 on a priority basis.

Subsequently, when the number of rotations of the engine increases and the pressure of oil ejected from the pump 1 increases, the pressure of oil in the lubricating oil passage 13 also increases, and the spool 31 gradually opens the lubricating oil passage 13 until a fully opened state, from the state shown in FIG. 3 to the state shown in FIG. 4, and then from the state shown in FIG. 4 to the state shown in FIG. 5. Accordingly, oil is sufficiently supplied to the main gallery 8 that requires a large amount of lubricating oil as the number of rotations of the engine increases. When the number of rotations of the engine has increased, the valve timing control device 2 naturally requires the oil pressure. Since the ejection pressure from the pump 1 has absolutely increased, a sufficient amount of oil is supplied also to the valve timing control device 2. Subsequently, even when the retard control is performed and the pressure of oil in the operating oil passage 14 acts on the rear face of the second pressure receiving face 31*b*, the spool 31 is kept in the state in which the lubricating oil passage 13 is fully opened. That is to say, if the oil temperature is higher than the first set temperature T1, the spool 31 adjusts the flow passage area of the lubricating oil passage 13 depending only on the pressure level of oil in the lubricating oil passage 13.

FIG. 8(*c*) shows relationships between the pressure of oil ejected from the pump 1, the pressure of oil supplied to the valve timing control device 2, and the pressure of oil supplied to the main gallery 8 at that time. In the state (III) in FIG. 3, the lubricating oil passage 13 has been narrowed, and, thus, the rate of an increase in the pressure of oil on the main gallery 8 decreases, and the rate of an increase in the pressure of oil on the valve timing control device 2 increases. In the state (IV) in FIG. 4 in which the spool 31 starts to be projected toward the lubricating oil passage 13, the flow passage area of the lubricating oil passage 13 starts to increase, and, thus, the rate of an increase in the pressure of oil on the main gallery 8 increases, and the rate of an increase in the pressure of oil on the valve timing control device 2 decreases. In the state (V) in FIG. 5 in which the spool 31 has been projected toward the lubricating oil passage 13 to the extent possible, the lubricating oil passage 13 has been fully opened, and, thus, the pressure of oil on the main gallery 8 and the pressure of oil on the valve timing control device 2 both follow an increase in the pressure of oil ejected from the pump 1.

Incidentally, the valve timing control device 2 has, albeit only slightly, small gaps between constituent components. Thus, particularly when the oil viscosity is low, oil may leak (be exuded) from small gaps, and the oil pressure may not efficiently act on the valve timing control device 2. In order to actuate the valve timing control device 2 in such a case, it is necessary to increase the size of the pump 1, thereby increasing the ejection pressure from the pump 1. That is to say, a power for driving the pump 1 becomes necessary, and the fuel efficiency of the engine may be poor instead.

Accordingly, if the oil temperature further increases to become higher than a second set temperature T2 and the oil viscosity decreases, electricity is not fed to the OCV 5 (OFF), as shown in FIG. 8(*a*). That is to say, the OCV 5 is kept at the retard control state, the retard oil passage 12B is connected to the oil ejection passage 11A, and the advance oil passage 12A is connected to the oil return passage 11B. Accordingly, the relative rotational phase is at the most retarded phase, and the lock mechanism provides a locked state. In this manner, if the oil temperature becomes higher than the second set temperature T2, the actuation of the valve timing control device 2 is stopped, and the power required by the pump is reduced.

Note that the second set temperature T2 is higher than the first set temperature T1. Furthermore, for example, the first set temperature T1 may be 55 to 65° C., and the second set temperature T2 may be 100 to 110° C., but the temperatures may be set at other values.

[Second Embodiment]

Next, a second embodiment of the oil pressure control apparatus according to the present invention will be described with reference to FIGS. 9 to 16. Note that the configuration of the pump, the valve timing control device, the OCV, and the operations of the valve timing control device are similar to those in the first embodiment, and, thus a description thereof has been omitted, and only aspects different from those in the first embodiment will be mainly described. The same members and portions as those in the first embodiment are denoted by the same reference numerals as the first embodiment.

Figure 9:
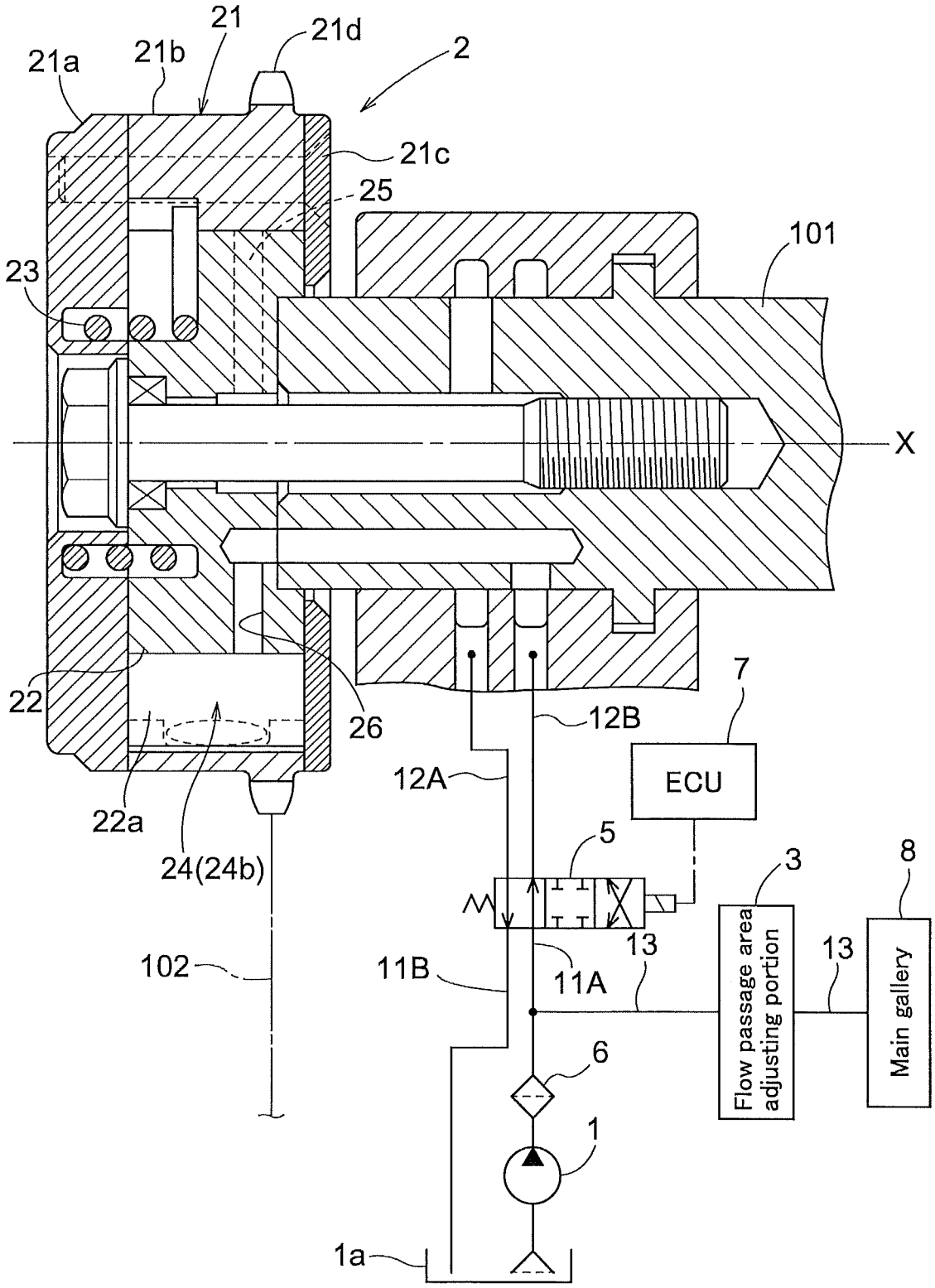
FIG. 9 is a view showing the overall configuration of an oil pressure control apparatus according to a second embodiment of the present invention.
Figure 10:
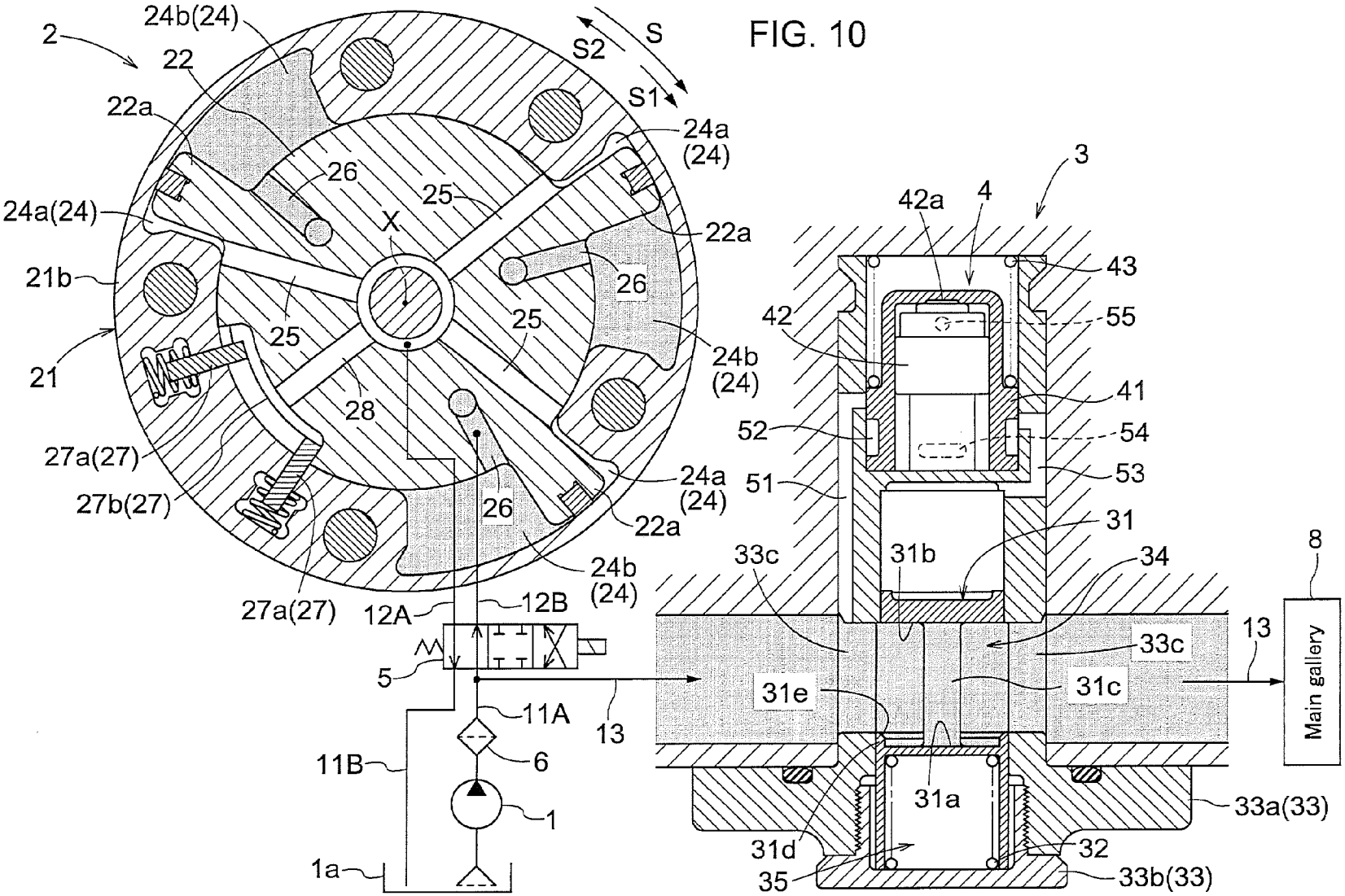
FIG. 10 is a cross-sectional view showing a state of the oil pressure control apparatus when the oil temperature is lower than the first set temperature T1.

As shown in FIG. 9, the overall configuration of the oil pressure control apparatus is substantially similar to that in the first embodiment, but is different from the first embodiment in that there is no operating oil passage 14 that is connected to the flow passage area adjusting portion 3. In this embodiment, as shown in FIG. 10, the operating oil passage 14 is replaced by a thermosensor control portion 4. The thermosensor control portion 4 includes a thermosensor accommodating member 41 that is provided slidable in a space inside the valve body 33 and a thermosensor main body portion 42 that is accommodated so as to be covered by the thermosensor accommodating member 41.

Figure 15:
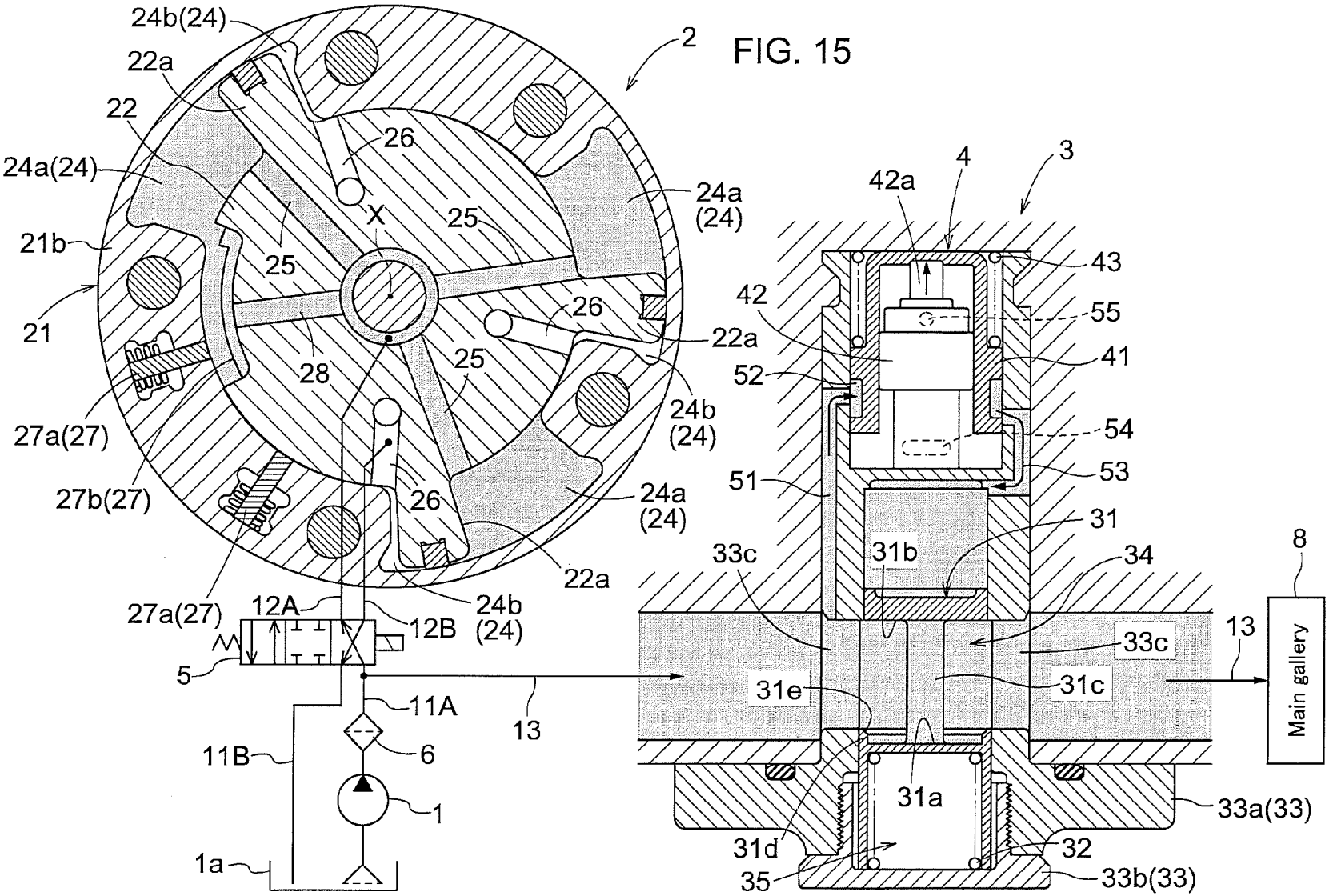
FIG. 15 is a view showing a state of the oil pressure control apparatus when the oil temperature becomes higher than the second set temperature T2.

The thermosensor main body portion 42 is fixed to the valve body 33. The thermosensor accommodating member 41 is slidable between the valve body 33 and the thermosensor main body portion 42, but is always biased by a spring 43 toward the lubricating oil passage 13. The thermosensor main body portion 42 internally accommodates thermowax (not shown), and the thermowax is set so as to be expanded if the oil temperature becomes higher than the second set temperature T2. When the thermowax is expanded, as shown in FIG. 15, a movable member 42*a* that has been accommodated inside the thermosensor main body portion 42 when the oil temperature is lower than the second set temperature T2 is projected to lift the thermosensor accommodating member 41.

The side wall of the valve body 33 is provided with an oil supply passage 51 that is connected to the lubricating oil passage 13 and an operating oil passage 53 that supplies oil to the rear face of the second pressure receiving face 31*b* of the spool 31. Furthermore, the outer circumferential face of the thermosensor accommodating member 41 is provided with a ring-shaped oil passage 52. If the oil temperature is lower than the second set temperature T2, as shown in FIGS. 10 to 14, the oil supply passage 51 and the ring-shaped oil passage 52 are not interconnected to each other, and oil is not supplied to the operating oil passage 53. On the other hand, if the oil temperature becomes higher than the second set temperature T2, as shown in FIG. 15, the thermosensor accommodating member 41' is lifted by the movable member 42*a*, and the oil supply passage 51, the ring-shaped oil passage 52, and the operating oil passage 53 are interconnected to each other. As a result, oil is supplied from the lubricating oil passage 13 to the rear face of the second pressure receiving face 31*b*, the spool 31 moves toward the first pressure receiving face 31*a*, and the lubricating oil passage 13 is kept in the fully opened state.

Figure 11:
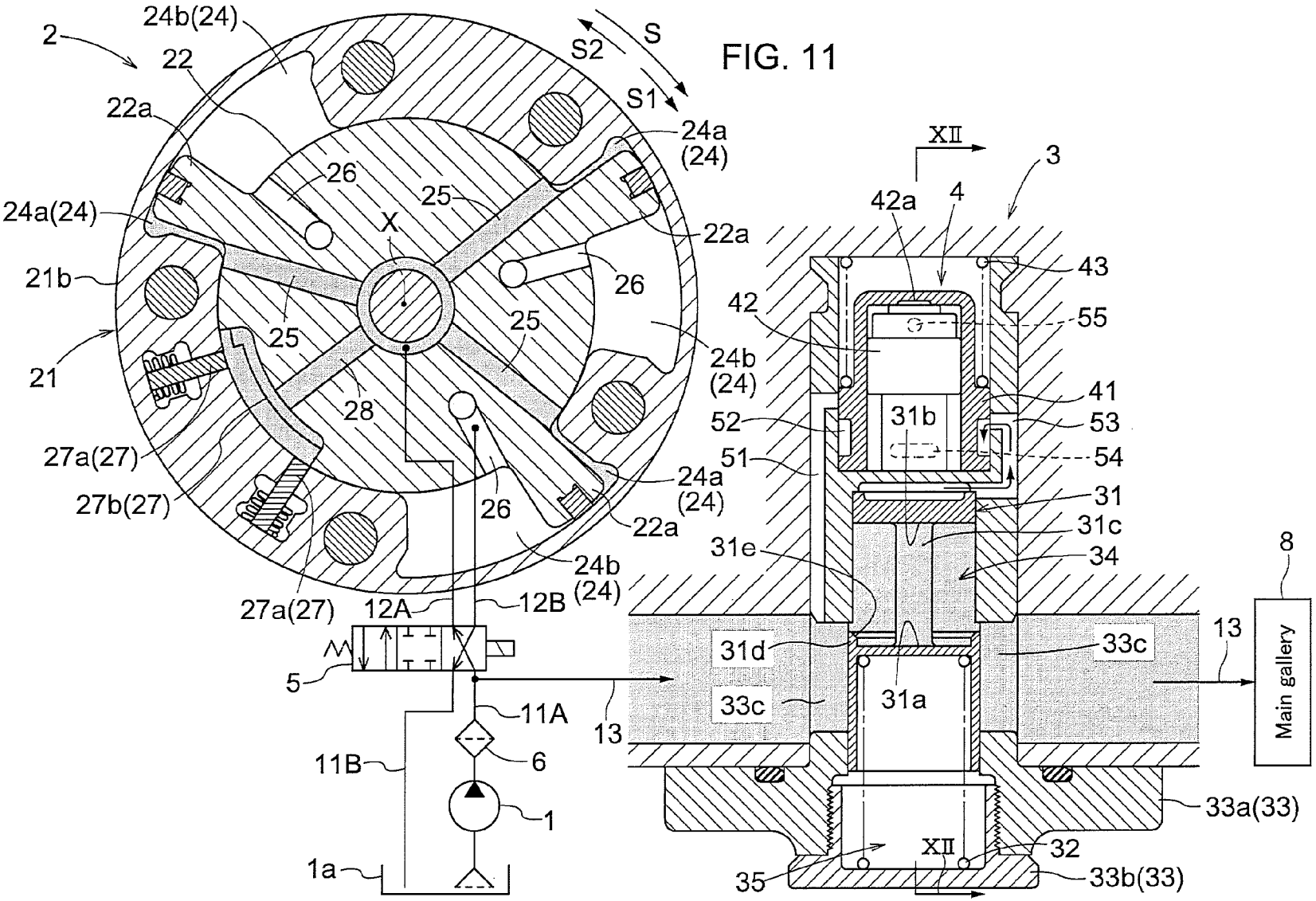
FIG. 11 is a cross-sectional view showing a state of the oil pressure control apparatus when the oil temperature is between the first set temperature T1 and the second set temperature T2, and the number of rotations of the engine is low.
Figure 12:
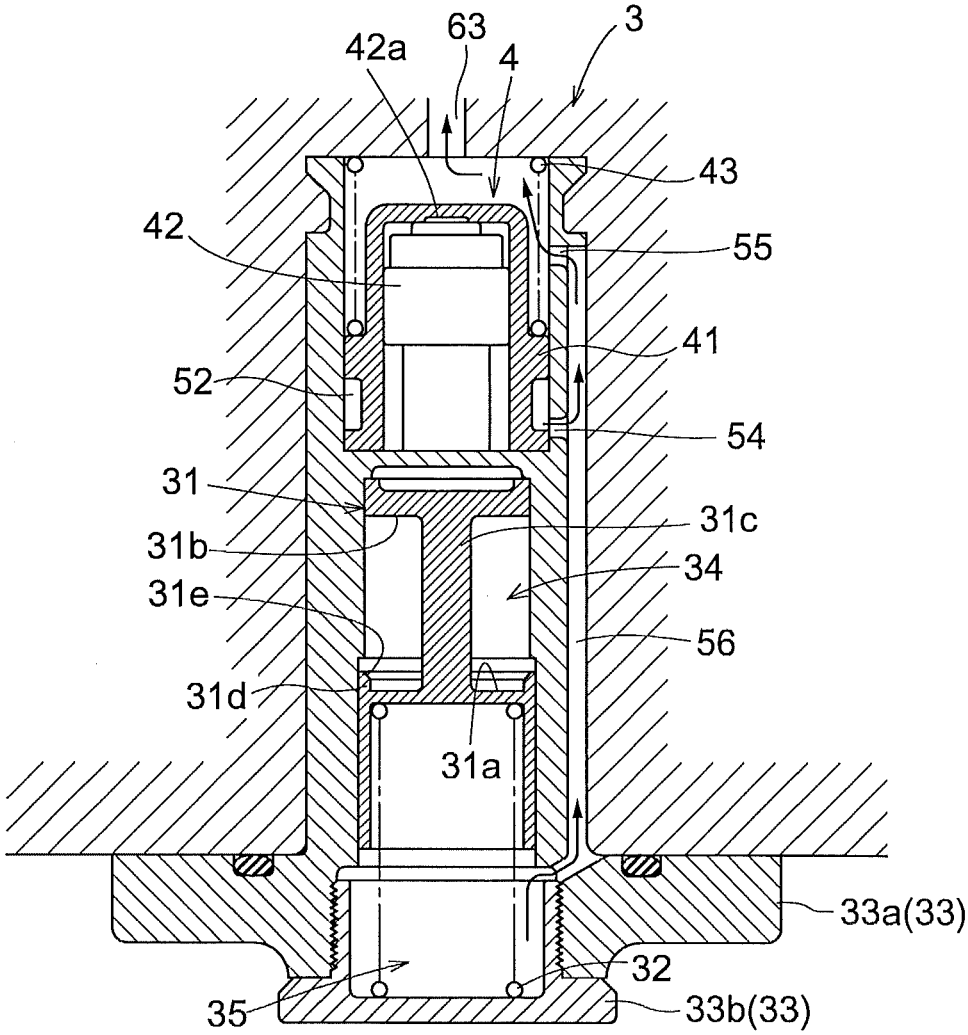
FIG. 12 is a cross-sectional view taken along the line XII-XII in FIG. 11.

As shown in FIGS. 11 and 12, the valve body 33 is provided with a first discharge hole 54 and a second discharge hole 55. If the oil temperature is lower than the second set temperature T2, oil that is present on the rear face of the second pressure receiving face 31*b* of the spool 31 is discharged via the operating oil passage 53, the ring-shaped oil passage 52, the first discharge hole 54, an oil discharge passage 56, and the second discharge hole 55 from a discharge hole 63. Since oil and air can pass through the discharge hole 63, the thermosensor accommodating member 41 can smoothly operate. Furthermore, oil that has been accumulated inside the thermosensor accommodating member 41 due to a leak or the like through a gap between the valve body 33 and the thermosensor accommodating member 41 is also discharged via the first discharge hole 54. Furthermore, the spring accommodating space 35 is interconnected via the oil discharge passage 56 to the discharge hole 63, and air and oil in the spring accommodating space 35 can be released, and, thus, the spool 31 can be smoothly actuated.

Hereinafter, an operation of the oil pressure control apparatus will be described with reference to the drawings. Note that "X", "XI", "XIII", "XIV", and "XV" in FIGS. 16(*a*) to 16(*c*) respectively correspond to the states in FIGS. 10, 11, 13, 14, and 15.

Immediately after start of the engine, the oil temperature is low, and, thus, the oil viscosity is high, and an oil leak is small. Accordingly, although the amount of ejection from the pump 1 is small, the pressure of oil in the oil ejection passage 11A and the lubricating oil passage 13 is high. Accordingly, as shown in FIG. 10, the pressure of oil in the lubricating oil passage 13 moves the spool 31 toward the first pressure receiving face 31*a* and opens the lubricating oil passage 13, and, thus, oil is supplied to the main gallery 8 on a priority basis over the valve timing control device 2. As a result, the pump 1 does not act in vain on the valve timing control device 2 that does not have to operate immediately after start of the engine.

Figure 16A:
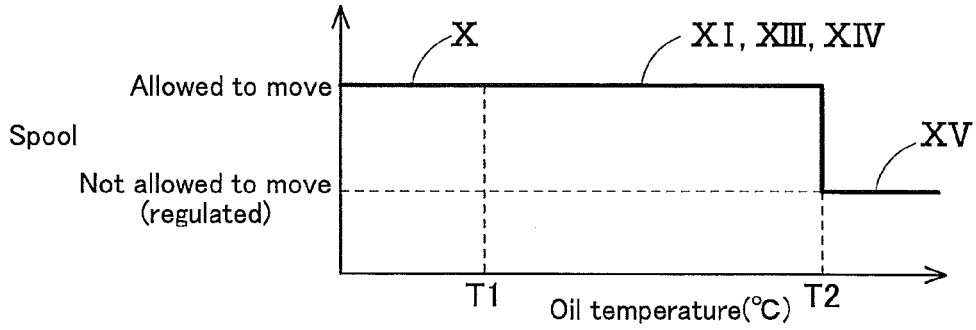
FIG. 16(*a*) shows a graph of a relationship between the oil temperature and the operation state of a flow passage area adjusting portion, FIG. 16(*b*) shows graphs of relationships between the number of rotations of an engine and the pressure of oil on constituent portions when the oil temperature is lower than the first set temperature T1 or is higher than the second set temperature T2, and FIG. 16(*c*) shows graphs of relationships between the number of rotations of an engine and the pressure of oil on constituent portions when the oil temperature is between the first set temperature T1 and the second set temperature T2.
Figure 16B:
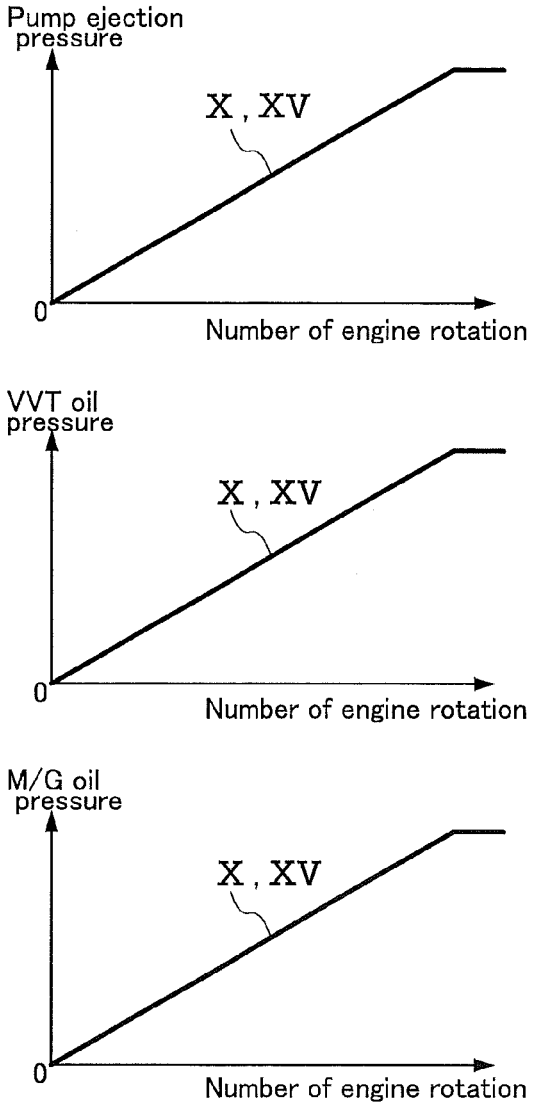
Figure 16C:
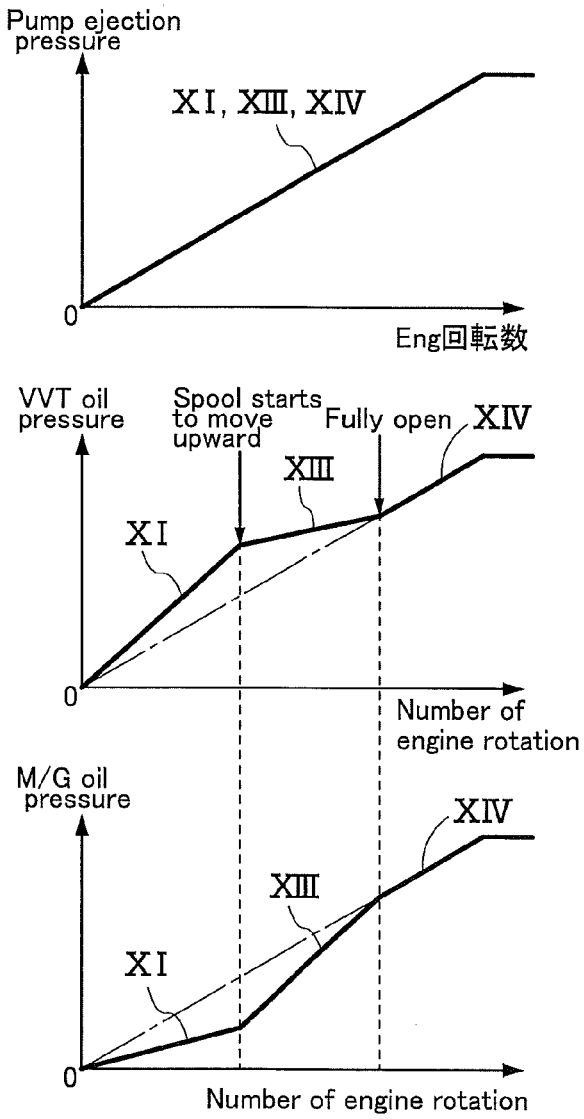

FIG. 16(*b*) shows relationships between the pressure of oil ejected from the pump 1, the pressure of oil supplied to the valve timing control device 2, and the pressure of oil supplied to the main gallery 8 in the state (X) in FIG. 10. Since the lubricating oil passage 13 has been fully opened, the pressure of oil on the main gallery 8 and the pressure of oil on the valve timing control device 2 both follow a change in the pressure of oil ejected from the pump 1.

When the warm-up progresses to some extent and the oil temperature is higher than the first set temperature T1, the oil viscosity decreases and the oil pressure decreases. Accordingly, as shown in FIG. 11, the spool 31 is biased by the spring 32 and is moved toward the second pressure receiving face 31*b*. After the warm-up has been completed, if the accelerator is depressed, electricity is fed to the OCV 5, and the valve timing control device 2 is in the advance control. The valve timing control device 2 requires the oil pressure for stable start. Since the flow passage area of the lubricating oil passage 13 has been narrowed to a minimum, oil is supplied to the valve timing control device 2 on a priority basis, and the valve timing control device 2 is smoothly started.

Figure 13:
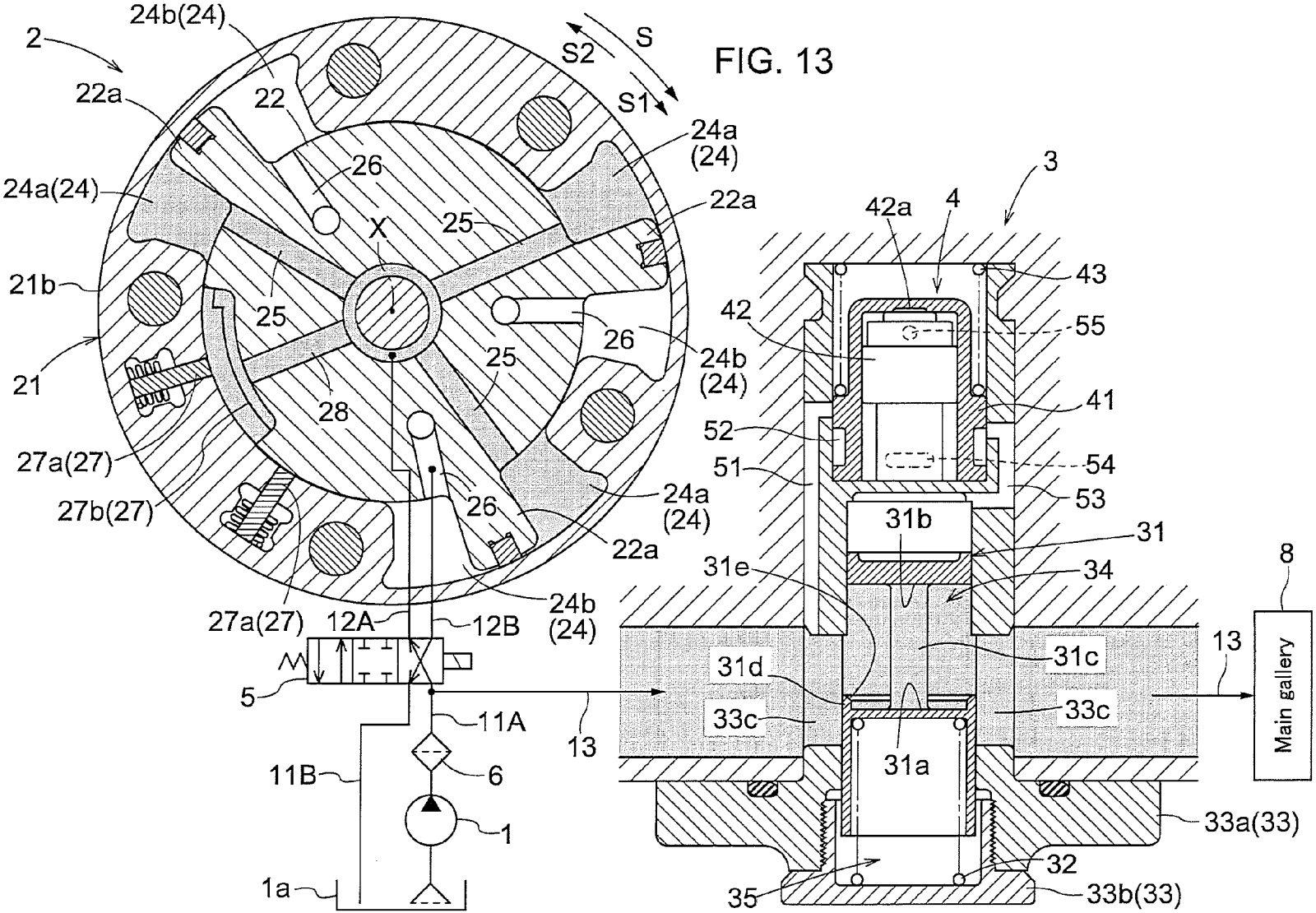
FIG. 13 is a cross-sectional view showing a state of the oil pressure control apparatus when the oil temperature is between the first set temperature T1 and the second set temperature T2, and the number of rotations of the engine is in the course of increasing.
Figure 14:
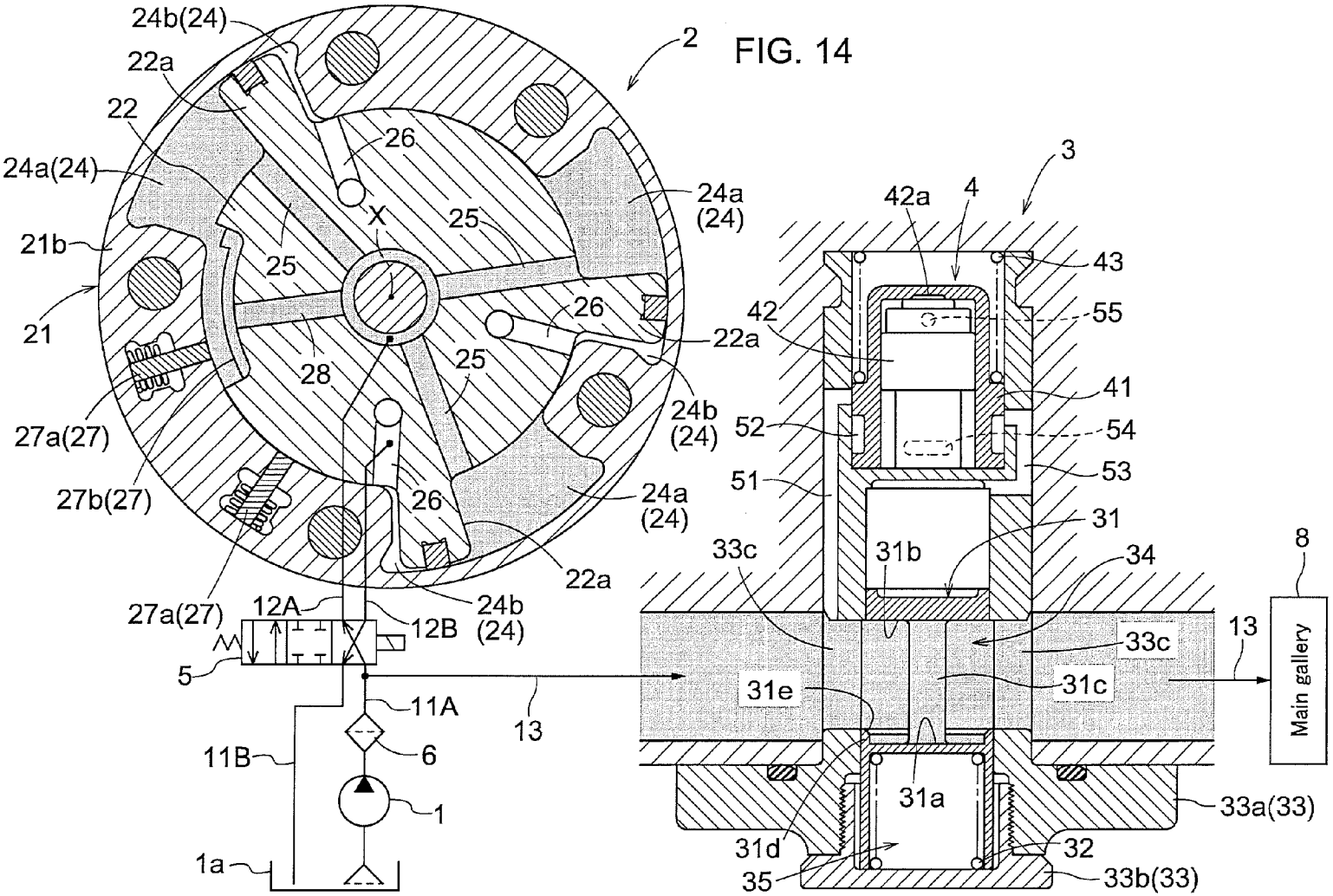
FIG. 14 is a view showing a state of the oil pressure control apparatus when the oil temperature is between the first set temperature T1 and the second set temperature T2, and the number of rotations of the engine is high.

Subsequently, when the number of rotations of the engine increases and the pressure of oil ejected from the pump 1 increases, the pressure of oil in the lubricating oil passage 13 also increases, and the spool 31 gradually opens the lubricating oil passage 13 until a fully opened state as shown in FIG. 14, by being displaced from the state shown in FIG. 11 to the state shown in FIG. 13, and then from the state shown in FIG. 13 to the state shown in FIG. 14. Accordingly, oil is sufficiently supplied to the main gallery 8 that requires a large amount of lubricating oil as the number of rotations of the engine increases. When the number of rotations of the engine has increased, the valve timing control device 2 also requires the oil pressure at the same time. Since the ejection pressure from the pump 1 has absolutely increased, a sufficient amount of oil is supplied also to the valve timing control device 2.

FIG. 16(*c*) shows relationships between the pressure of oil ejected from the pump 1, the pressure of oil supplied to the valve timing control device 2, and the pressure of oil supplied to the main gallery 8 at that time. In the state (XI) in FIG. 11, the lubricating oil passage 13 has been narrowed, and, thus, the rate of a change in the pressure of oil on the main gallery 8 decreases, and the rate of a change in the pressure of oil on the valve timing control device 2 increases. In the state (XIII) in FIG. 13 in which the spool 31 starts to move toward the first pressure receiving face 31*a*, the flow passage area of the lubricating oil passage 13 starts to increase, and, thus, the rate of a change in the pressure of oil on the main gallery 8 increases, and the rate of a change in the pressure of oil on the valve timing control device 2 decreases. In the state (XIV) in FIG. 14 in which the lubricating oil passage 13 has been fully opened, the pressure of oil on the main gallery 8 and the pressure of oil on the valve timing control device 2 both follow a change in the pressure of oil ejected from the pump 1.

In this manner, if the oil temperature is lower than the second set temperature T2, the spool 31 adjusts the flow passage area of the lubricating oil passage 13 depending only on the pressure level of oil in the lubricating oil passage 13.

If the oil temperature further increases to become higher than the second set temperature T2 and the oil viscosity excessively decreases, in the valve timing control device 2, oil leaks (is exuded) from small gaps between constituent components. However, as shown in FIG. 15, since the thermosensor control portion 4 is actuated, the oil supply passage 51, the ring-shaped oil passage 52, and the operating oil passage 53 are interconnected to each other, and oil is supplied from the lubricating oil passage 13 to the rear face of the second pressure receiving face 31*b*. As a result, the lubricating oil passage 13 is kept in the fully opened state, and the amount of oil supplied to the valve timing control device 2 can be minimized. In this manner, if the oil temperature becomes higher than the second set temperature T2, the pump 1 can be suppressed from acting in vain on a priority basis over the control of the valve timing control device 2.

FIG. 16(*b*) shows relationships between the pressure of ejected oil, the pressure of oil supplied to the valve timing control device 2, and the pressure of oil supplied to the main gallery 8 at that time. Since the lubricating oil passage 13 has been fully opened, the pressure of oil on the main gallery 8 and the pressure of oil on the valve timing control device 2 both follow a change in the pressure of oil ejected from the pump 1.

In summary, as shown in FIG. 16(*a*), if the oil temperature is lower than the second set temperature T2, the spool 31 can operate according to the pressure of oil in the lubricating oil passage 13, and, if the oil temperature becomes higher than the second set temperature T2, the spool 31 is regulated so as to fully open the lubricating oil passage 13 with the action of the thermosensor control portion 4, and does not move regardless of whether the pressure of oil in the lubricating oil passage 13 is large or small.

Figure 17:
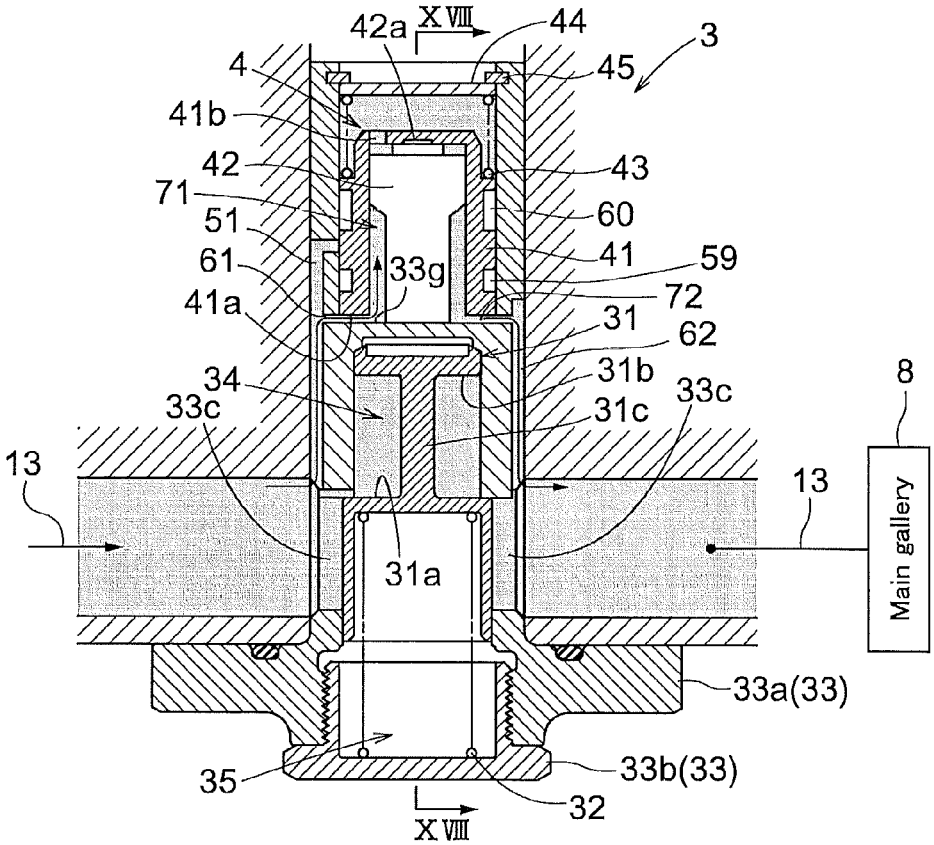
FIG. 17 is a cross-sectional view when a thermosensor control portion is in a non-actuated state according to another embodiment.
Figure 18:
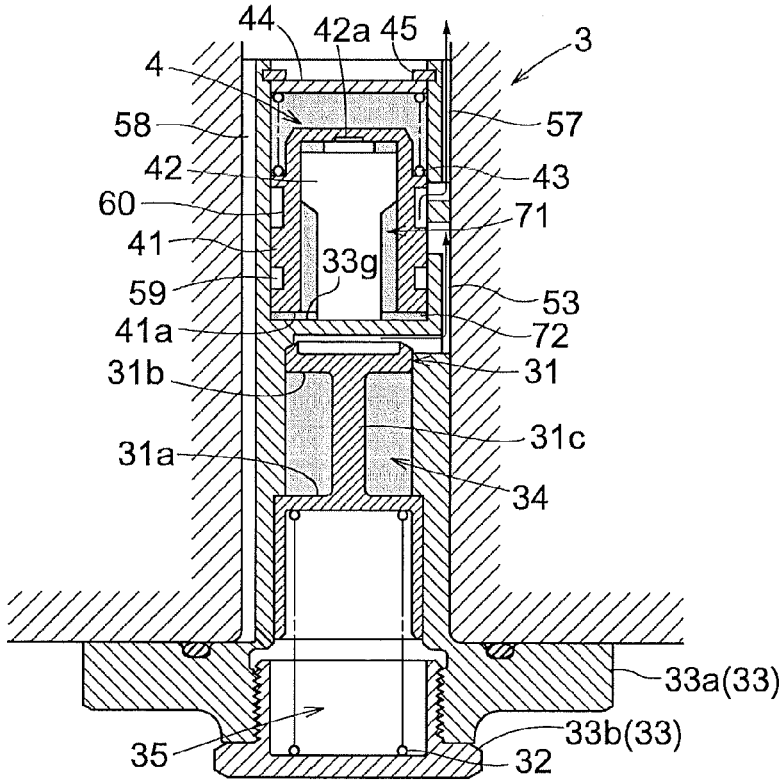
FIG. 18 is a cross-sectional view taken along the line XVIII-XVIII in FIG. 17.
Figure 19:
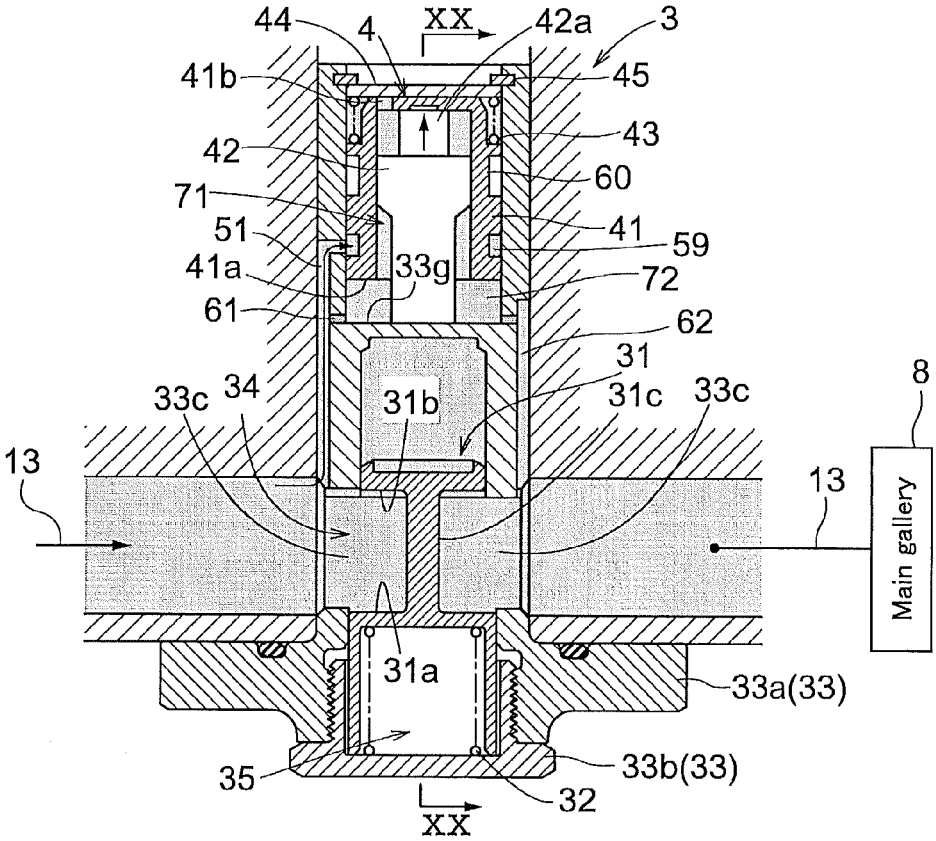
FIG. 19 is a cross-sectional view when the thermosensor control portion is in an actuated state according to the other embodiment.
Figure 20:
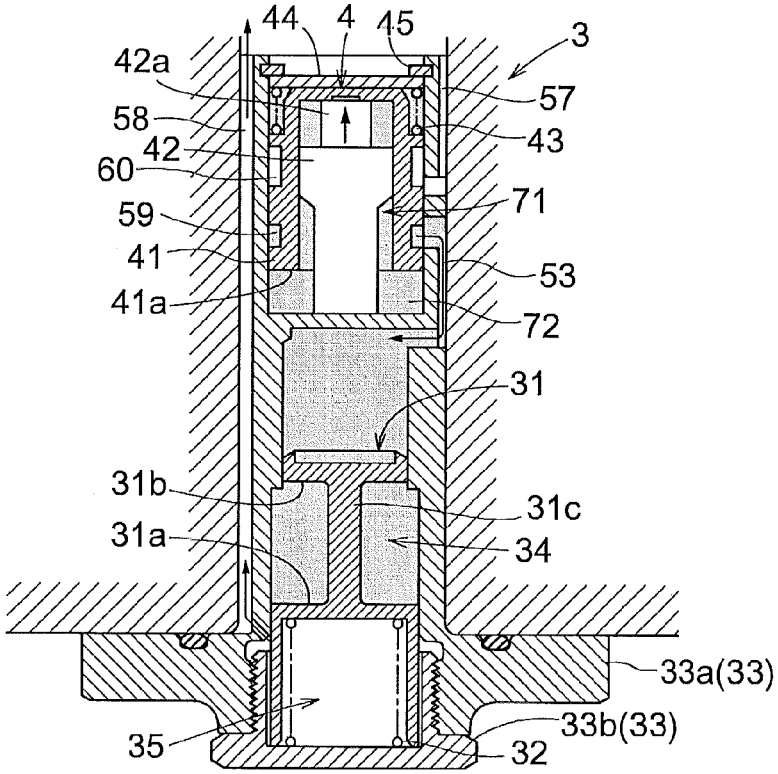
FIG. 20 is a cross-sectional view taken along the line XX-XX in FIG. 19.

Hereinafter, another embodiment of the thermosensor control portion 4 will be described with reference to FIGS. 17 to 20. FIGS. 17 and 18 show a state in which, when the oil temperature is lower than the second set temperature T2 and the thermosensor control portion 4 is not actuated, the spool 31 has moved toward the second pressure receiving face 31*b* to the extent possible (the lubricating oil passage 13 has been narrowed to a minimum). FIGS. 19 and 20 show a state in which, when the oil temperature becomes higher than the second set temperature T2 and the thermosensor control portion 4 is actuated, the spool 31 has moved toward the first pressure receiving face 31*a* to the extent possible (the lubricating oil passage 13 has been opened to a maximum). The series of control and the overall configuration are similar to those in the second embodiment, and aspects different from those in the second embodiment will be mainly described. The same members and portions as those in the second embodiment are denoted by the same reference numerals as the second embodiment.

The thermosensor main body portion 42 is formed in an arrangement space 71 inside the body main body 33*a* of the valve body 33, and is placed and fixed to a placement face 33*g* forming a bottom face of the arrangement space 71. The thermosensor main body portion 42 has a cylindrical shape, and internally accommodates thermowax (not shown). The thermosensor main body portion 42 is provided with the movable member 42*a* that can be projected from and withdrawn into the thermosensor main body portion 42. When the thermowax is expanded and the movable member 42*a* is projected, the cup-shaped thermosensor accommodating member 41 provided so as to cover the thermosensor main body portion 42 moves upward in the drawings resisting the biasing force of the spring 43.

In this embodiment, even in a non-actuated state in which the movable member 42*a* has been withdrawn into the thermosensor main body portion 42 and the thermosensor accommodating member 41 has been moved by the biasing force of the spring 43 toward the placement face 33*g* to the extent possible, a clearance 72 is ensured between an end face 41*a* of the thermosensor accommodating member 41 and the placement face 33*g*. The body main body 33*a* of the valve body 33 is provided with the oil supply passage 51 that supplies oil from the lubricating oil passage 13 via the thermosensor control portion 4 to the rear face of the second pressure receiving face 31*b* of the spool 31 when the thermosensor control portion 4 is in an actuated state. The oil supply passage 51 branches in mid-course into a heat transmission oil passage 61 that is interconnected to the clearance 72.

If the oil temperature is lower than the second set temperature T2 and the thermosensor control portion 4 is in the non-actuated state, as shown in FIG. 17, oil is supplied from the lubricating oil passage 13 via the heat transmission oil passage 61 and the clearance 72 to the arrangement space 71. Accordingly, the oil temperature is easily transmitted to the thermowax accommodated in the thermosensor main body portion 42, and the sensitivity of the thermosensor control portion 4 to a change in the oil temperature is improved.

In order to prevent the thermosensor accommodating member 41 from being moved by the pressure of oil supplied to the arrangement space 71 upward in the drawings and putting the thermosensor control portion 4 in the actuated state regardless of the state in which the thermosensor control portion 4 has to be kept in the non-actuated state because the oil temperature is lower than the second set temperature T2, the thermosensor accommodating member 41 is provided with a through hole 41*b*. The oil supplied to the arrangement space 71 flows through a clearance between the thermosensor accommodating member 41 and the thermosensor main body portion 42 and the through hole 41*b* and is supplied also to a space that accommodates the spring 43. As a result, oil pressures act on the thermosensor accommodating member 41 from both sides and cancel each other, and, thus, the thermosensor accommodating member 41 can be prevented from being moved by the pressure of oil supplied to the arrangement space 71.

In this embodiment, the space that accommodates the spring 43 is sealed by a cover member 44. Furthermore, in order to suppress an oil leak through a gap between the body main body 33*a* of the valve body 33 and the cover member 44, a ring-shaped sealing member 45 that can be engaged with the body main body 33*a* is provided.

The body main body 33*a* of the valve body 33 is provided with, in addition to the oil supply passage 51 and the heat transmission oil passage 61, the operating oil passage 53 that supplies oil to the rear face of the second pressure receiving face 31*b* of the spool 31, an oil return passage 62 that returns oil from the arrangement space 71 to the downstream side in the lubricating oil passage 13, and a first oil discharge passage 57 and a second oil discharge passage 58 that expose oil to the atmosphere.

With respect to the oil supply passage 51 (or the heat transmission oil passage 61), in a planar view, the oil return passage 62 is positioned at 180 degrees from the oil supply passage 51, the operating oil passage 53 and the first oil discharge passage 57 are positioned at 90 degrees from the oil supply passage 51, and the second oil discharge passage 58 is positioned at 90 degrees in the opposite direction from the oil supply passage 51. Since the heat transmission oil passage 61 and the oil return passage 62 are positioned opposing each other at 180 degrees, the oil that flows from the heat transmission oil passage 61 via the clearance 72 into the arrangement space 71, and then flows out from the arrangement space 71 via the clearance 72 into the oil return passage 62 uniformly flows around the thermosensor main body portion 42, and, thus, heat can be evenly and uniformly transmitted to the thermowax.

The outer circumferential face of the thermosensor accommodating member 41 is provided with a first ring-shaped oil passage 59 that functions when supplying oil to the rear face of the second pressure receiving face 31*b* of the spool 31 and a second ring-shaped oil passage 60 that is connected to the first oil discharge passage 57. The first ring-shaped oil passage 59 is configured so as not to be interconnected to the oil supply passage 51 and the operating oil passage 53 when the thermosensor control portion 4 is in the non-actuated state (FIGS. 17 and 18). Furthermore, the second ring-shaped oil passage 60 is configured so as to be interconnected to the operating oil passage 53 and the first oil discharge passage 57 when the thermosensor control portion 4 is in the non-actuated state (FIG. 18), and to be interconnected only to the first oil discharge passage 57 when the thermosensor control portion 4 is in the non-actuated state (FIG. 20).

With the thus configured oil passages, regardless of whether the thermosensor control portion 4 is in the non-actuated state or the actuated state, oil is supplied from the lubricating oil passage 13 via the heat transmission oil passage 61 and the clearance 72 to the arrangement space 71, and is returned from the arrangement space 71 via the clearance 72 and the oil return passage 62 to the lubricating oil passage 13. Furthermore, when the thermosensor control portion 4 is in the non-actuated state, oil that is present on the rear face of the second pressure receiving face 31*b* of the spool 31 is exposed to the atmosphere via the operating oil passage 53, the second ring-shaped oil passage 60, and the first oil discharge passage 57 (FIG. 18). Accordingly, the pressure of oil in the lubricating oil passage 13 decreases, and the spool 31 can be smoothly actuated also when the spool 31 moves toward the second pressure receiving face 31*b*. Furthermore, when the pressure of oil in the lubricating oil passage 13 increases and the spool 31 moves toward the first pressure receiving face 31*a*, oil inside the spring accommodating space 35 is exposed to the atmosphere via the second oil discharge passage 58 formed in the body main body 33*a* of the valve body 33 (FIG. 20). Accordingly, also at that time, the spool 31 can be smoothly moved.

In this embodiment, as shown in FIG. 17, the flow opening portion 33*c* on the downstream side formed in the body main body 33*a* of the valve body 33 is formed smaller than that on the upstream side, and, in a state in which the spool 31 has narrowed the lubricating oil passage 13 to a minimum, a path between the flow passage space 34 and the downstream side in the lubricating oil passage 13 is blocked by the spool 31. That is to say, in this state, the upstream side and the downstream side in the lubricating oil passage 13 with respect to the flow passage area adjusting portion 3 are interconnected to each other only via one path through the heat transmission oil passage 61, the clearance 72, the arrangement space 71, the clearance 72, and the oil return passage 62. Accordingly, the pressure of oil supplied to the main gallery 8 is determined only by determining the minimum diameter of this one path, and, thus, the oil control can be easily performed.

As shown in FIGS. 19 and 20, when the oil temperature becomes higher than the second set temperature T2 and the thermowax is expanded, the movable member 42*a* is projected, and the thermosensor accommodating member 41 is lifted. In this actuated state of the thermosensor control portion 4, oil in the lubricating oil passage 13 is supplied via the oil supply passage 51, the first ring-shaped oil passage 59, and the operating oil passage 53 to the rear face of the second pressure receiving face 31*b* of the spool 31. As a result, the spool 31 moves toward the first pressure receiving face 31*a* resisting the biasing force of the spring 32, and the flow passage area adjusting portion 3 keeps the lubricating oil passage 13 in the maximum opened state.

Note that, in this embodiment, the clearance 72 is configured so as to be formed over the entire circumference between the end face 41*a* of the thermosensor accommodating member 41 and the placement face 33*g*, but part of the end face 41*a* may be configured so as to be in contact with the placement face 33*g* as long as the interconnection between the heat transmission oil passage 61 and the oil return passage 62 is not blocked and the thermosensitive properties of the thermowax are not impaired. Furthermore, instead of providing the through hole 41*b* in the thermosensor accommodating member 41, or, in addition to providing the through hole 41*b*, it is also possible to increase the length of the oil supply passage 51 such that oil is directly supplied to the space that accommodates the spring 43. Furthermore, in a state in which the spool 31 has narrowed the lubricating oil passage 13 to a minimum, the flow passage space 34 and the downstream side in the lubricating oil passage 13 may be interconnected to each other.

[Other Embodiments]

(1) The foregoing embodiments showed the case in which the first predetermined portion is the valve timing control device 2 on the intake valve side, but there is no limitation to this. As the first predetermined portion, it is also possible to apply a valve timing control device on the exhaust valve side or oil supply portions such as a piston jet or a turbocharger.

(2) The foregoing embodiments showed the example in which the lock mechanism 27 locks the relative rotational phase at the most retarded phase, but there is no limitation to this. For example, it is also possible to apply a lock mechanism that locks the relative rotational phase at an intermediate phase between the most retarded phase and the most advanced phase or at the most advanced phase.

(3) The foregoing embodiments showed the lock mechanism 27 merely as an exemplary mechanism that locks the relative rotational phase. For example, it is also possible to apply a lock mechanism including a lock member that is projected and withdrawn along the axis X, or a lock mechanism in which one lock member corresponds to one lock groove. Moreover, it is also possible to apply a configuration in which the relative rotational phase is locked by pressing a vane against an end face of a fluid pressure chamber, without providing a lock mechanism.

(4) The foregoing embodiments showed the case in which the torsion spring 23 that biases the inner rotor 22 to the advance side is included, but there is no limitation to this. For example, it is also possible to include a torsion spring that biases the inner rotor 22 to the retard side.

(5) The foregoing embodiment showed the example in which the operating oil passage 14 is an oil passage that is branched from the retard oil passage 12B, but there is no limitation to this. For example, if the present invention is applied to a valve timing control device for the exhaust valve, if the lock mechanism locks the relative rotational phase at a phase other than the most retarded phase, if the relationship between a displacement force based on the cam torque variation and a biasing force of the torsion spring is changed, or if the method for cancelling the lock mechanism is changed, it is also possible to connect the operating oil passage 14 to the advance oil passage 12A. Furthermore, it is also conceivable to connect a retainer operating oil passage to both of the advance oil passage and the retard oil passage.

(6) The foregoing embodiments showed the example in which the retard control can be performed when electricity is fed to the OCV 5, and the advance control can be performed when the feeding of electricity is stopped, but there is no limitation to this. It is also possible to apply a configuration in which the advance control can be performed when electricity is fed to the OCV, and the retard control can be performed when the feeding of electricity is stopped.

(7) The foregoing embodiment showed the configuration in which the thermosensor control portion 4 is regulated so as to displace the spool 31 to fully open the lubricating oil passage 13 if the oil temperature becomes higher than the second set temperature T2, but there is no limitation to this. The degree of the lubricating oil passage 13 opened by the spool 31 may be set as appropriate as necessary.

REFERENCE SIGNS LIST

1 Pump
2 Valve timing control device (first predetermined portion)
3 Flow passage area adjusting portion
4 Thermosensor control portion
5 OCV (control valve)
8 Main gallery (second predetermined portion)
11A Oil ejection passage (first flow passage)
13 Lubricating oil passage (second flow passage)
21 Housing (driving-side rotatable member)
22 Inner rotor (following-side rotatable member)
31 Spool
31*a* First pressure receiving face
31*b* Second pressure receiving face
31*d* Wall portion
31*e* Tapered face
32 Spring (biasing member)
33 Valve body
33*f* Inclined portion
33*g* Placement face
41 Thermosensor accommodating member
41*a* End face
42 Thermosensor main body portion
42*a* Movable member
59 First ring-shaped oil passage (ring-shaped oil passage)
61 Heat transmission oil passage
62 Oil return passage
71 Arrangement space
72 Clearance
101 Camshaft

The invention claimed is:

1. An oil pressure control apparatus, comprising:

a pump that ejects oil by being driven by rotation of an engine;

a first flow passage that interconnects the pump and a first predetermined portion;

a second flow passage that is branched from the first flow passage and that supplies oil to a second predetermined portion, which is different from the first predetermined portion; and a flow passage area adjusting portion that is provided in the second flow passage, and that increases a flow passage area of the second flow passage when a pressure of oil in the second flow passage increases and reduces the flow passage area when the pressure of the oil decreases;

wherein the flow passage area adjusting portion is configured including a spool that is formed such that a first pressure receiving face and a second pressure receiving face having an area smaller than that of the first pressure receiving face oppose each other with the second flow passage interposed therebetween, and that can move according to a pressure of oil in the second flow passage, and a biasing member that biases the spool in a direction from the first pressure receiving face to the second pressure receiving face.

2. The oil pressure control apparatus according to claim 1, wherein a circumferential edge portion of the first pressure receiving face is provided with a wall portion that is projected toward the second pressure receiving face.

3. The oil pressure control apparatus according to claim 2, wherein an inner circumferential edge portion at a tip end of the wall portion is chamfered.

4. The oil pressure control apparatus according to claim 1, wherein a valve body that accommodates the spool is provided with an inclined portion with which a flow direction of oil flowing through the second flow passage is directed toward the first pressure receiving face.

5. The oil pressure control apparatus according to claim 1, wherein a biasing force of the biasing member is larger than a pressing force in a direction for increasing the flow passage area of the second flow passage, which is caused to act by a pressure of oil in the second flow passage while the engine is idling.

6. The oil pressure control apparatus according to claim 1, wherein the first predetermined portion is a valve timing control device including: a driving-side rotatable member that rotates in synchronization with a crankshaft; and a following-side rotatable member that is disposed in coaxial with the driving-side rotatable member and that rotates in synchronization with a camshaft;

wherein a relative rotational phase of the following-side rotatable member with respect to the driving-side rotatable member is displaced according to supply or discharge of oil.

7. The oil pressure control apparatus according to claim 6, wherein, in a case in which an oil temperature is lower than a predetermined first set temperature or is higher than a predetermined second set temperature, a control valve of the valve timing control device is switched to a predetermined valve position, so that oil is supplied from the first flow passage to a rear face of the second pressure receiving face, and the flow passage area of the second flow passage is kept in a maximum state.

8. The oil pressure control apparatus according to claim 1, wherein, in a case in which an oil temperature is higher than a predetermined second set temperature, a thermosensor control portion including thermowax that is expanded according to an increase in the temperature is actuated, so that oil is supplied from the second flow passage to a rear face of the second pressure receiving face, and the flow passage area of the second flow passage is kept in a maximum state.

9. The oil pressure control apparatus according to claim 8, wherein, in the thermosensor control portion, an arrangement space containing a thermosensor main body portion that accommodates the thermowax is provided with an oil supply passage that supplies oil from the second flow passage.

10. The oil pressure control apparatus according to claim 9, wherein an oil return passage through which oil flows from the arrangement space to a downstream side in the second flow passage is provided.

11. The oil pressure control apparatus according to claim 10, wherein a cup-shaped thermosensor accommodating member covers the thermosensor main body portion that is provided on a placement face of a valve body, and a clearance is formed between an end face of the thermosensor accommodating member and the placement face.

12. The oil pressure control apparatus according to claim 11, wherein the thermosensor main body portion is provided with a movable member that supports the thermosensor accommodating member and that is projected when the thermowax is expanded, and, in a case in which the thermosensor accommodating member is moved according to the projection of the movable member, a ring-shaped oil passage formed on an outer circumferential face of the thermosensor accommodating member is interconnected to the second flow passage, so that oil is supplied to a rear face of the second pressure receiving face.

13. The oil pressure control apparatus according to claim 10, wherein, in a state in which the spool has narrowed the second flow passage to a minimum, oil that flows on an upstream side in the second flow passage can flow into a flow passage space formed between the first pressure receiving face and the second pressure receiving face, and cannot flow out from the flow passage space to a downstream side in the second flow passage.

* * * * *